US011298937B2

(12) United States Patent
Oikawa et al.

(10) Patent No.: US 11,298,937 B2
(45) Date of Patent: Apr. 12, 2022

(54) PRINTING APPARATUS AND CONTROL METHOD THEREFOR

(71) Applicant: CANON KABUSHIKI KAISHA, Tokyo (JP)

(72) Inventors: Yuhei Oikawa, Yokohama (JP); Toshiyuki Chikuma, Tokyo (JP); Yutaka Kano, Kawasaki (JP); Kohei Sato, Yokohama (JP); Takuya Fukasawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 57 days.

(21) Appl. No.: 16/987,689

(22) Filed: Aug. 7, 2020

(65) Prior Publication Data

US 2021/0060927 A1 Mar. 4, 2021

(30) Foreign Application Priority Data

Aug. 29, 2019 (JP) ..... JP2019-157267

(51) Int. Cl.

| | |
|---|---|
| ***B41J 2/045*** | (2006.01) |
| ***B41J 2/165*** | (2006.01) |
| *B41J 2/14* | (2006.01) |
| *B41J 2/04* | (2006.01) |

(52) U.S. Cl.

CPC ..... *B41J 2/0451* (2013.01); *B41J 2/0454* (2013.01); *B41J 2/04563* (2013.01); *B41J 2/04565* (2013.01); *B41J 2/04585* (2013.01); *B41J 2/165* (2013.01); *B41J 2/04* (2013.01); *B41J 2/14427* (2013.01)

(58) Field of Classification Search

CPC .... B41J 2/04563; B41J 2/04565; B41J 2/165; B41J 2/04585; B41J 2/04; B41J 2/14427; B41J 2202/18; B41J 2/0458; B41J 2/14129; B41J 2/14153

See application file for complete search history.

(56) References Cited

U.S. PATENT DOCUMENTS

| | | | | |
|---|---|---|---|---|
| 7,914,106 | B2 * | 3/2011 | Takabayashi | B41J 2/0458 347/19 |
| 8,186,798 | B2 | 5/2012 | Aoki et al. | |
| 9,033,471 | B2 | 5/2015 | Oonuki et al. | |
| 9,114,607 | B2 | 8/2015 | Ishii et al. | |
| 10,766,251 | B2 | 9/2020 | Oikawa et al. | |
| 2004/0095410 | A1 * | 5/2004 | Miyashita | B41J 2/04555 347/19 |

(Continued)

FOREIGN PATENT DOCUMENTS

JP 2008-000914 A 1/2008

*Primary Examiner* — Kristal Feggins

(74) *Attorney, Agent, or Firm* — Venable LLP

(57) ABSTRACT

A method for inspecting an ink discharge status based on a temperature change of an energy generating element includes calculating a difference value between a value obtained by statistics of information indicating ink discharge statuses obtained for a plurality of nozzles close to a target nozzle and the information obtained for the target nozzle; comparing the calculated difference value with a predetermined threshold; and judging the ink discharge status for the target nozzle based on a result of the comparison. This enables to appropriately detect a nozzle which is in a discharge failure status due to an ink droplet adhered to a discharge surface of a printhead or the like.

20 Claims, 13 Drawing Sheets

(56) References Cited

U.S. PATENT DOCUMENTS

| | | | | |
|---|---|---|---|---|
| 2019/0009600 | A1* | 1/2019 | Moriguchi | B41J 2/175 |
| 2019/0299599 | A1 | 10/2019 | Kano et al. | |
| 2019/0299601 | A1 | 10/2019 | Oikawa et al. | |
| 2020/0070503 | A1 | 3/2020 | Chikuma et al. | |
| 2020/0108597 | A1 | 4/2020 | Oikawa et al. | |

* cited by examiner

TEMPERATURE CHANGE (dT/dt)
TIME (μsec)
0 1 2 3 4 5 6 7 8 9 10
203
THRESHOLD VOLTAGE FOR DISCHARGE INSPECTION (TH)

PRINTING APPARATUS AND CONTROL METHOD THEREFOR

BACKGROUND OF THE INVENTION

Field of the Invention

The present invention relates to a printing apparatus and a control method therefor, and particularly to, for example, a printing apparatus to which a printhead incorporating an element substrate with a plurality of print elements is applied to perform printing in accordance with an inkjet method, and a control method for judging the ink discharge status of the printing apparatus.

Description of the Related Art

One of inkjet printing methods of discharging ink droplets from nozzles and adhering them to a paper sheet, a plastic film, or another print medium uses a printhead with print elements that generate thermal energy to discharge ink. As for a printhead according to this method, for example, an electrothermal transducer that generates heat in accordance with energization, a drive circuit for it, and the like can be formed using the same process as a semiconductor manufacturing process. Therefore, this printhead has the advantage in that high density implementation of nozzles is easy and higher-resolution printing can be achieved.

In this printhead, an ink discharge failure may occur in all or some of the nozzles of the printhead due to a factor such as clogging of a nozzle caused by a foreign substance or ink with increased viscosity, bubbles trapped in an ink supply channel or a nozzle, or a change in wettability on a nozzle surface. To avoid degradation in image quality caused when such discharge failure occurs, a recovery operation of recovering an ink discharge status and a complementary operation by other nozzles are preferably, quickly executed. However, to execute these operations quickly, it is very important to correctly and appropriately judge the ink discharge status and the occurrence of the discharge failure.

According to this background, there are conventionally proposed various ink discharge status judgment methods and complementary printing operations, and apparatuses to which these methods and operations are applied.

Japanese Patent Laid-Open No. 2008-000914 discloses a method of detecting a decrease in temperature at the time of normal discharge to detect a failure of ink discharge from a printhead. According to Japanese Patent Laid-Open No. 2008-000914, at the time of normal discharge, a point (feature point) at which a temperature drop rate changes appears after a predetermined time elapses after the time when a detected temperature reaches a highest temperature but no such point appears at the time of a discharge failure. Therefore, the ink discharge status is judged by detecting the presence/absence of the feature point. Furthermore, Japanese Patent Laid-Open No. 2008-000914 discloses an arrangement in which a temperature detection element is provided immediately below a print element that generates thermal energy for ink discharge, and discloses, as a method of detecting the presence/absence of the feature point, a method of detecting the feature point as a peak value by differential processing of a change in temperature.

The discharge status judgment method disclosed in Japanese Patent Laid-Open No. 2008-000914 can differentiate between a normal discharge status and a non-discharge status correctly and quickly. However, in the above-described conventional example, it is impossible to judge a nozzle in a discharge failure status depending on a situation, in which discharge inspection is performed, by only differentiating between the two statuses of the normal discharge status and the non-discharge status. Consequently, recovery processing may not be executed at an appropriate timing, thereby causing an image failure such as stripes.

SUMMARY OF THE INVENTION

Accordingly, the present invention is conceived as a response to the above-described disadvantages of the conventional art.

For example, a printing apparatus and a control method therefor according to this invention are capable of judging an ink discharge status more correctly.

According to one aspect of the present invention, there is provided a printing apparatus comprising: a printhead including a plurality of nozzles each configured to discharge ink, a plurality of energy generating elements respectively provided in the plurality of nozzles and each configured to generate energy used for discharging the ink from the nozzle, a plurality of detection elements provided in correspondence with the plurality of energy generating elements, and an output portion configured to output a signal indicating ink discharge statuses of the plurality of nozzles using the plurality of detection elements; an inspection unit configured to inspect the ink discharge status while changing a threshold for judging the discharge status of a target nozzle based on the signal output by the output portion; an obtaining unit configured to obtain, for the target nozzle, information concerning a change point at which a judgment result obtained by inspecting the ink discharge status by the inspection unit changes; a calculation unit configured to calculate a difference value between a value obtained by statistics of pieces of information obtained by the obtaining unit for a plurality of nozzles close to the target nozzle and the information obtained by the obtaining unit for the target nozzle; a first comparison unit configured to compare the difference value calculated by the calculation unit with a predetermined first threshold; and a first judgment unit configured to judge the ink discharge status for the target nozzle based on a result of the comparison by the first comparison unit.

According to another aspect of the present invention, there is provided a control method for a printing apparatus for printing on a print medium using a printhead including a plurality of nozzles each configured to discharge ink, a plurality of energy generating elements respectively provided in the plurality of nozzles and each configured to generate energy used for discharging the ink from the nozzle, a plurality of detection elements provided in correspondence with the plurality of energy generating elements, and an output portion configured to output a signal indicating ink discharge statuses of the plurality of nozzles using the plurality of detection elements, the method comprising: inspecting the ink discharge status while changing a threshold for judging the discharge status of a target nozzle based on the signal output by the output portion; obtaining, for the target nozzle, information concerning a change point at which a judgment result obtained by inspecting the ink discharge status in the inspecting changes; calculating a difference value between a value obtained by statistics of pieces of information obtained for a plurality of nozzles close to the target nozzle and the information obtained for the target nozzle; comparing the calculated difference value with a predetermined first threshold; and judging the ink discharge status for the target nozzle based on a result of the comparison.

The invention is particularly advantageous since it is possible to discriminate the discharge status of each nozzle more correctly, and execute processing at an appropriate timing in accordance with a discrimination result. This can print a high-quality image without stripes or the like.

Further features of the present invention will become apparent from the following description of exemplary embodiments (with reference to the attached drawings).

DESCRIPTION OF THE EMBODIMENTS

Figure 1:
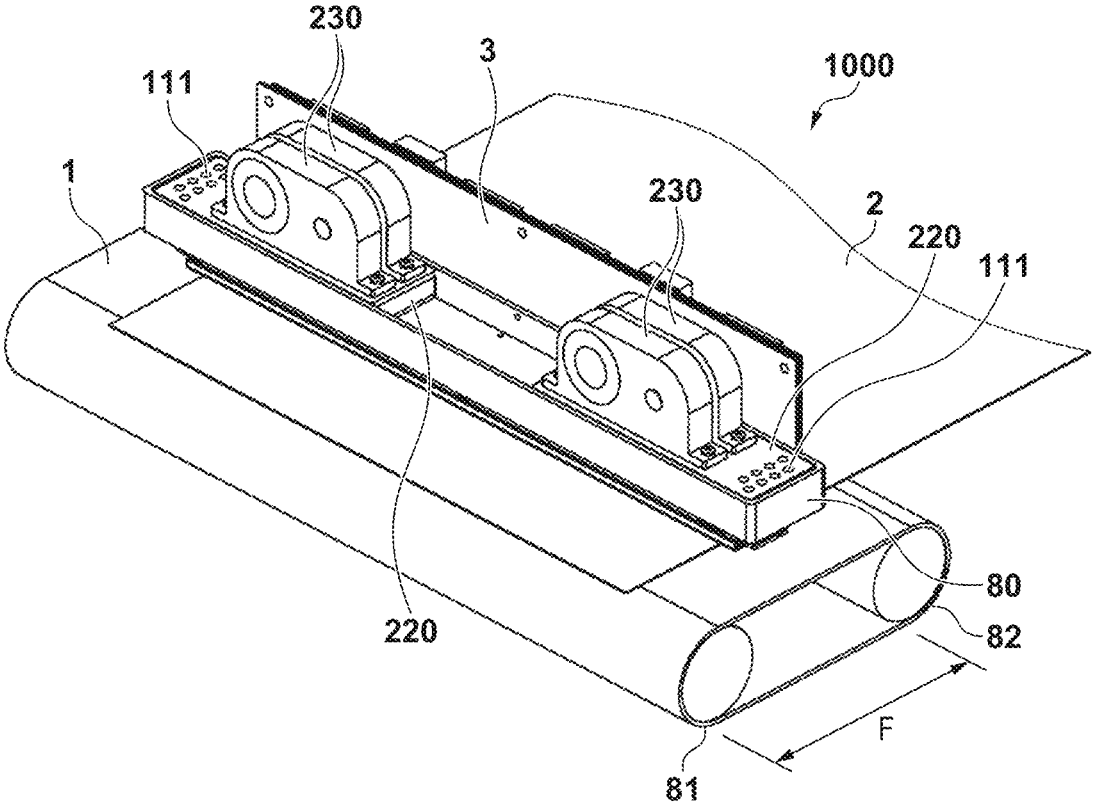
FIG. 1 is a perspective view for explaining the structure of a printing apparatus including a full-line printhead according to an embodiment of the present invention.

Exemplary embodiments of the present invention will now be described in detail in accordance with the accompanying drawings. It should be noted that the following embodiments are not intended to limit the scope of the appended claims. A plurality of features are described in the embodiments. Not all the plurality of features are necessarily essential to the present invention, and the plurality of features may arbitrarily be combined. In addition, the same reference numerals denote the same or similar parts throughout the accompanying drawings, and a repetitive description will be omitted.

In this specification, the terms "print" and "printing" not only include the formation of significant information such as characters and graphics, but also broadly include the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be broadly interpreted to be similar to the definition of "print" described above. That is, "ink" includes a liquid which, when applied onto a print medium, can form images, figures, patterns, and the like, can process the print medium, and can process ink. The processing of ink includes, for example, solidifying or insolubilizing a coloring agent contained in ink applied to the print medium.

Further, the term "nozzle" means an ink orifice or a liquid channel communicating with it, unless otherwise specified. A "print element" is provided in correspondence to an orifice, and used to mean an element for generating energy used to discharge ink. For example, the print element may be provided in a position opposite to the orifice.

An element substrate for a printhead (head substrate) used below means not merely a base made of a silicon semiconductor, but an arrangement in which elements, wirings, and the like are arranged.

Further, "on the substrate" means not merely "on an element substrate", but even "on the surface of the element substrate" and "inside the element substrate near the surface". In the present invention, "built-in" means not merely arranging respective elements as separate members on the base surface, but integrally forming and manufacturing respective elements on an element substrate by a semiconductor circuit manufacturing process or the like.

<Printing Apparatus Mounted with Full-Line Printhead (FIG. 1)>

FIG. 1 is a perspective view showing the schematic arrangement of a printing apparatus 1000 using a full-line printhead that performs printing by discharging ink according to an embodiment of the present invention.

As shown in FIG. 1, the printing apparatus 1000 is a line type printing apparatus that includes a conveyance unit 1 that conveys a print medium 2 and a full-line printhead 3 arranged to be approximately orthogonal to the conveyance direction of the print medium 2, and performs continuous printing while conveying the plurality of print media 2 continuously or intermittently. The full-line printhead 3 includes ink orifices arrayed in a direction intersecting the conveyance direction of the print medium. The full-line printhead 3 is provided with a negative pressure control unit 230 that controls the pressure (negative pressure) in an ink channel, a liquid supply unit 220 that communicates with the negative pressure control unit 230, and a liquid connecting portion 111 that serves as an ink supply and discharge port to the liquid supply unit 220.

A housing 80 is provided with the negative pressure control unit 230, the liquid supply unit 220, and the liquid connecting portion 111.

Note that the print medium 2 is not limited to a cut sheet, and may be a continuous roll sheet.

The full-line printhead (to be referred to as the printhead hereinafter) 3 can perform full-color printing by cyan (C), magenta (M), yellow (Y), and black (K) inks. A main tank and the liquid supply unit 220 serving as a supply channel for supplying ink to the printhead 3 are connected to the printhead 3. An electric controller (not shown) that transmits power and a discharge control signal to the printhead 3 is electrically connected to the printhead 3.

The print medium 2 is conveyed by rotating two conveyance rollers 81 and 82 provided apart from each other by a distance of F in the conveyance direction of the print medium 2.

The printhead according to this embodiment employs the inkjet method of discharging ink using thermal energy. Therefore, each orifice of the printhead 3 includes an electrothermal transducer (heater). The electrothermal transducer is provided in correspondence with each orifice. When a pulse voltage is applied to the corresponding electrothermal transducer in accordance with a print signal, ink is heated and discharged from the corresponding orifice. Note that the printing apparatus is not limited to the above-described printing apparatus using the full-line printhead whose printing width corresponds to the width of the print medium. For example, the present invention is also applicable to a so-called serial type printing apparatus that mounts, on a carriage, a printhead in which orifices are arrayed in the conveyance direction of the print medium and performs printing by discharging ink to the print medium while reciprocally scanning the carriage.

<Description of Control Arrangement (FIG. 2)>

Figure 2:
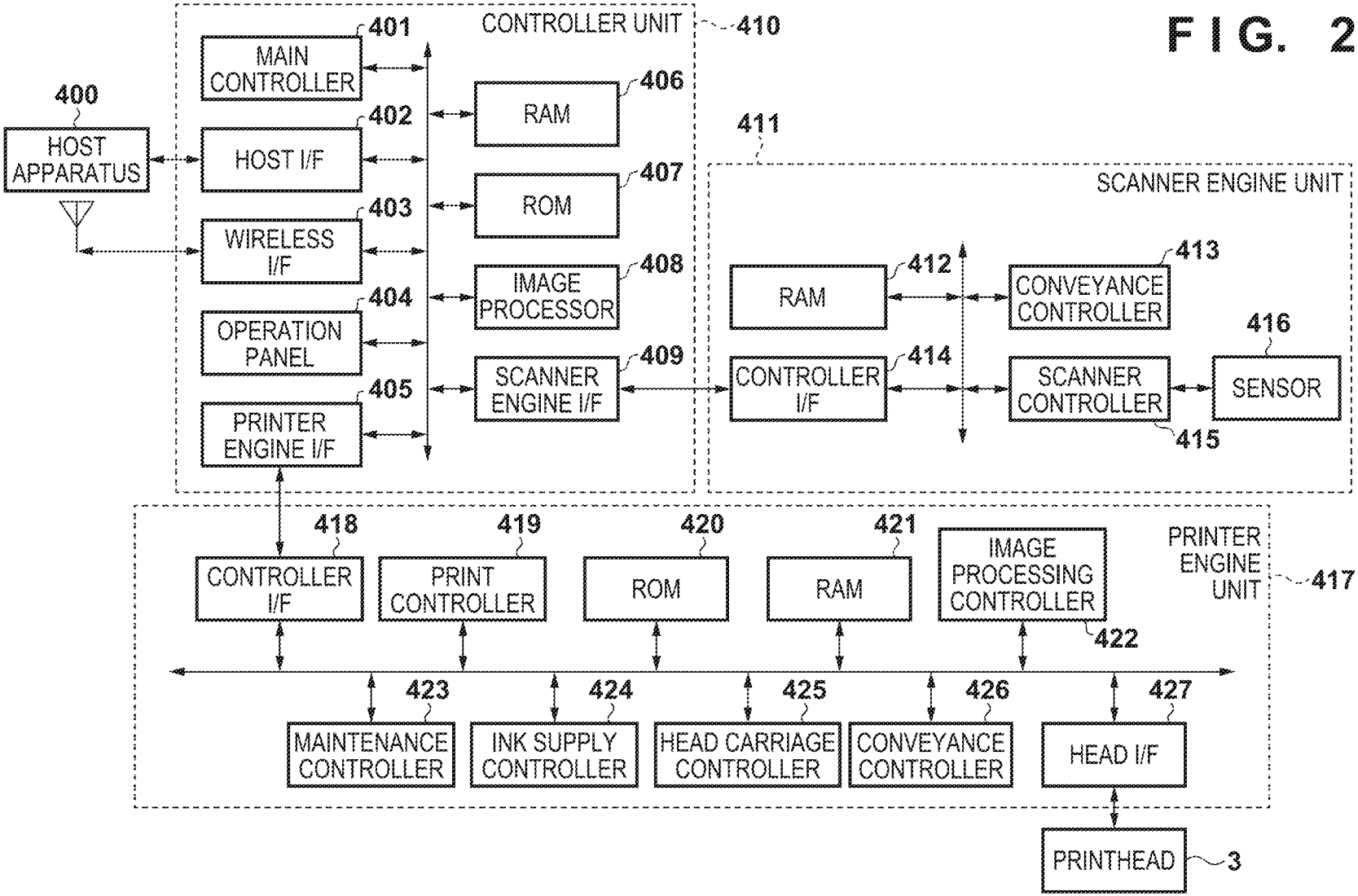
FIG. 2 is a block diagram showing the control arrangement of the printing apparatus shown in FIG. 1.

FIG. 2 is a block diagram showing the arrangement of a control circuit of the printing apparatus 1000.

As shown in FIG. 2, the printing apparatus 1000 is formed from a print engine unit 417 that mainly controls the printing unit, a scanner engine unit 411 that mainly controls the scanner unit, and a controller unit 410 that controls the overall printing apparatus 1000. A print controller 419 incorporating an MPU and a non-volatile memory (an EEPROM or the like) controls the various kinds of mechanisms of the print engine unit 417 in accordance with instructions from a main controller 401 of the controller unit 410. The various kinds of mechanisms of the scanner engine unit 411 are controlled by the main controller 401 of the controller unit 410.

The details of the control arrangement will be described hereinafter.

In the controller unit 410, the main controller 401, which is formed by a CPU, controls the overall printing apparatus 1000 in accordance with programs and various kinds of parameters stored in a ROM 407 by using a RAM 406 as a work area. For example, when a print job is input from a host apparatus 400 via a host I/F 402 or a wireless I/F 403, an image processing unit 408 will perform image processing on the received image data in accordance with the instruction of the main controller 401. The main controller 401 transmits the image data that has undergone the image processing to the print engine unit 417 via a print engine I/F 405.

Note that the printing apparatus 1000 may obtain image data from the host apparatus 400 via wireless communication or wired communication or may obtain image data from an external storage device (a USB memory or the like) connected to the printing apparatus 1000. The communication method to be used in the wireless communication or the wired communication is not particularly limited. For example, Wi-Fi® (Wireless Fidelity) or Bluetooth® is applicable as the communication method used in the wireless communication. Also, for example, a USB (Universal Serial Bus) or the like is applicable as the communication method used in the wired communication. Furthermore, for example, when a read instruction is input from the host apparatus 400, the main controller 401 transmits this instruction to the scanner engine unit 411 via a scanner engine I/F 409.

An operation panel 404 is a unit for a user to make an input operation or an output operation on the printing apparatus 1000. The user can instruct an operation such as copying, scanning, or the like, set a print mode, and recognize the information of the printing apparatus 1000 via the operation panel 404.

In the print engine unit 417, the print controller 419, which is configured by a CPU, controls the various kinds of mechanisms of the print engine unit 417 in accordance with the programs and various kinds of parameters stored in a ROM 420 by using a RAM 421 as a work area.

When various kinds of commands and image data are received via a controller I/F 418, the print controller 419 temporarily stores these commands and image data in the RAM 421. The print controller 419 causes an image processing controller 422 to convert the stored image data into print data so that the printhead 3 can use the data in the print operation. When the print data has been generated, the print controller 419 causes the printhead 3 to execute a print operation based on the print data via a head I/F 427. At this time, the print controller 419 will drive the conveyance rollers 81 and 82 via a conveyance control unit 426 to convey the print medium 2. Print processing is performed under the instruction of the print controller 419 by executing the print operation by the printhead 3 in synchronization with the conveyance operation of the print medium 2.

A head carriage control unit 425 changes the orientation and position of the printhead 3 in accordance with the operation state such as the maintenance state, the print state, or the like of the printing apparatus 1000. An ink supply control unit 424 controls the liquid supply units 220 so that the pressure of ink supplied to the printhead 3 will fall within a suitable range. A maintenance control unit 423 controls the operation of a cap unit and the operation of a wiping unit in a maintenance unit (not shown) when a maintenance operation is performed on the printhead 3.

In the scanner engine unit 411, the main controller 401 controls the hardware resources of the scanner controller 415 by using the RAM 406 as a work area in accordance with the programs and various kinds of parameters stored in the ROM 407. Accordingly, various kinds of mechanisms included in the scanner engine unit 411 are controlled. For example, the main controller 401 will control the hardware resources in a scanner controller 415 via a controller I/F 414 to convey an original, which has been placed on an ADF (not shown) by the user, by a conveyance control unit 413 and read the original by a sensor 416. The scanner controller 415 subsequently stores the read image data in a RAM 412.

Note that the print controller 419 can convert image data obtained in the manner described above into print data to cause the printhead 3 to execute a print operation based on the image data read by the scanner controller 415.

<Explanation of Maintenance Operation (FIG. 3)>

A maintenance operation for the printhead 3 will be described next.

Figure 3A:
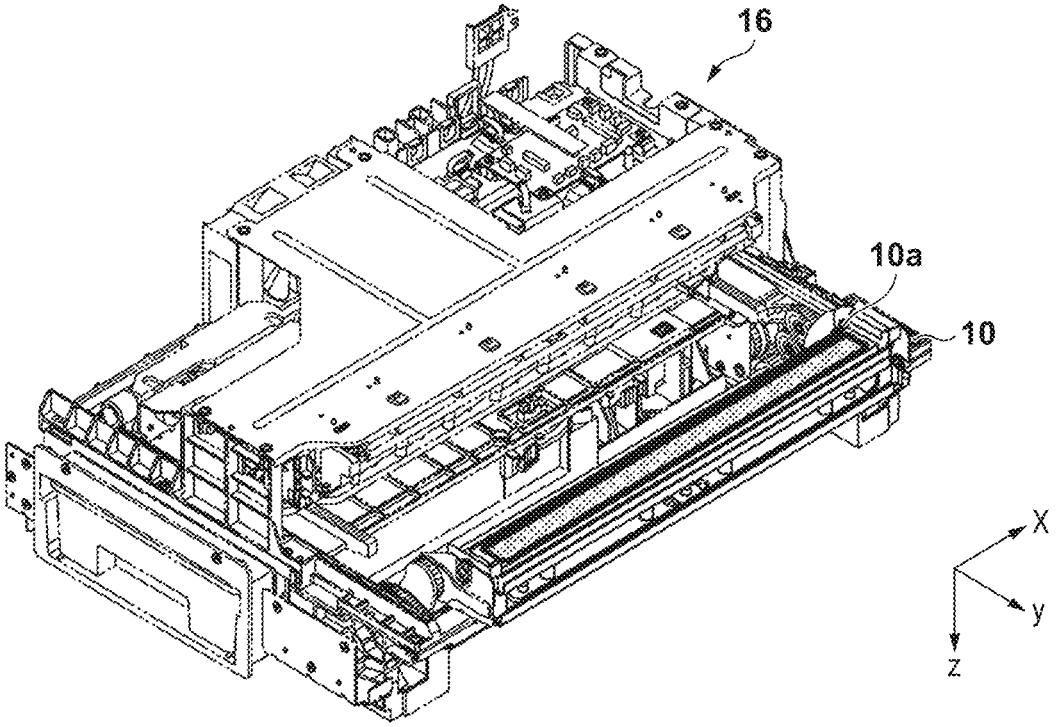
FIGS. 3A and 3B are views for explaining a maintenance unit.
Figure 3B:
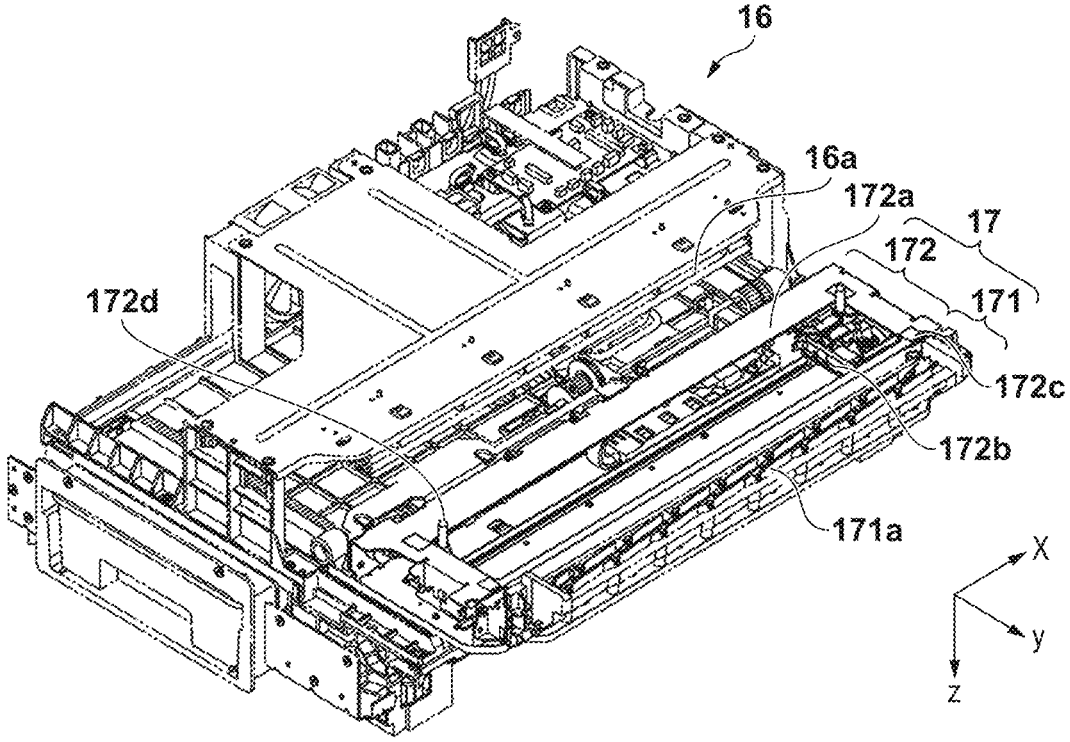

FIGS. 3A and 3B are perspective views each showing the arrangement of a maintenance unit. FIG. 3A shows a status in which a maintenance unit 16 is at a standby position, and FIG. 3B shows a status in which the maintenance unit 16 is at a maintenance position.

As shown in FIGS. 3A and 3B, the maintenance unit 16 includes a cap unit 10 and a wiping unit 17, and performs a maintenance operation by causing these units to operate at a predetermined timing.

When executing the maintenance operation for the printhead 3, the printhead 3 moves to the maintenance position at which the maintenance operation is possible. In a status other than a printing status and a maintenance status, the printhead 3 moves to the standby position.

As shown in FIG. 3A, when the printhead is at the standby position, the cap unit 10 moves upward in a vertical direction (z direction), and the wiping unit 17 is stored in the maintenance unit 16. The cap unit 10 includes a box-shaped cap member 10*a* extending in a y direction, and can suppress evaporation of ink from orifices by bringing the cap member 10*a* into tight contact with the orifice surface of the printhead 3. Furthermore, the cap unit 10 has a function of collecting ink discharged by preliminary discharge in a status in which the cap member 10*a* is in tight contact with the orifice surface of the printhead 3, and causing a suction pump (not shown) to suck the collected ink.

On the other hand, as shown in FIG. 3B, when the printhead is at the maintenance position, the cap unit 10 moves downward in the vertical direction (z direction), and the wiping unit 17 is drawn out from the maintenance unit 16. The wiping unit 17 includes two wiper units of a blade wiper unit 171 and a vacuum wiper unit 172.

In the blade wiper unit 171, blade wipers 171*a* for wiping the orifice surface along an x direction are arranged in the y direction in a length corresponding to the array region of the orifices. When performing a wiping operation using the blade wiper unit 171, the wiping unit 17 moves the blade wiper unit 171 in the x direction in a status in which the printhead is positioned at a height at which the printhead is contactable with the blade wipers 171*a*. With this movement operation, the blade wipers 171*a* wipe ink and the like adhered to the orifice surface.

At the entrance of the maintenance unit 16 when the blade wipers 171*a* are stored, a wet wiper cleaner 16*a* is arranged to remove ink adhered to the blade wipers 171*a* and also apply a wet liquid to the blade wipers 171*a*. Every time the blade wipers 171*a* are stored in the maintenance unit 16, the wet wiper cleaner 16*a* removes an adhered substance and applies a wet liquid. Then, the wet liquid is transferred to the orifice surface when the orifice surface is wiped next time, thereby preventing the orifice surface from drying.

On the other hand, the vacuum wiper unit 172 includes a flat plate 172*a* having an opening extending in the y direction, a carriage 172*b* movable in the y direction in the opening, and a vacuum wiper 172*c* mounted on the carriage 172*b*. The vacuum wiper 172*c* can wipe the orifice surface in the y direction along with the movement of the carriage 172*b*. At the tip of the vacuum wiper 172*c*, a suction port connected to the suction pump (not shown) is formed. Thus, when moving the carriage 172*b* in the y direction while causing the suction pump to operate, ink and the like adhered to the orifice surface of the printhead are sucked into the suction port while being wiped and collected by the vacuum wiper 172*c*. At this time, the flat plate 172*a* and positioning pins 172*d* provided at both ends of the opening are used to position the orifice surface with respect to the vacuum wiper 172*c*.

In this example, there are provided the first wiping processing in which wiping processing by the blade wiper unit 171 is performed and wiping processing by the vacuum wiper unit 172 is not performed, and the second wiping processing in which both the wiping processes are sequentially performed. When performing the first wiping processing, the print controller 419 draws out the wiping unit 17 from the maintenance unit 16 in a status in which the printhead 3 is retracted upward in the vertical direction (z direction) with reference to the maintenance position. Then, after moving the printhead 3 downward in the vertical direction (z direction) to a position at which the printhead 3 is contactable with the blade wipers 171*a*, the print controller 419 moves the wiping unit 17 into the maintenance unit 16. With this movement operation, the blade wipers 171*a* wipe ink and the like adhered to the orifice surface.

After the blade wiper unit 171 is stored, the print controller 419 moves the cap unit 10 upward in the vertical direction (z direction), and brings the cap member 10*a* into tight contact with the orifice surface of the printhead 3. Then, in this status, the printhead 3 is driven to perform preliminary discharge, and ink collected in the cap is sucked by the suction pump. A series of steps in the first wiping processing has been explained above.

Assume here that the first wiping processing is executed once every time a printing operation for 100 pages of print media is performed.

On the other hand, when performing the second wiping processing, the print controller 419 positions the printhead 3 at a height at which the printhead 3 abuts against the blade wipers 171*a*. In this status, the print controller 419 slides and draws out the wiping unit 17 from the maintenance unit 16. This causes the blade wipers 171*a* to perform the wiping operation on the orifice surface. Next, the orifice surface of the printhead 3 and the vacuum wiper unit 172 are positioned using the flat plate 172*a* and the positioning pins 172*d*, and then the above-described wiping operation by the vacuum wiper unit 172 is executed. After that, the printhead 3 is retracted upward in the vertical direction (z direction) to store the wiping unit 17. Then, similar to the first wiping processing, the cap unit 10 performs preliminary discharge into the cap member and an operation of sucking collected ink. A series of steps in the second wiping processing has been explained above.

As compared with the first wiping processing, the second wiping processing has a higher cleaning effect for the orifice surface but the processing time is longer. Therefore, assume that the second wiping processing is executed once every 50 times of execution of the first wiping processing. That is, the second wiping processing is executed once every time a printing operation for 5,000 pages of print media is performed.

<Explanation of Arrangement of Temperature Detection Element (FIGS. 4A to 4C)>

Figure 4C:
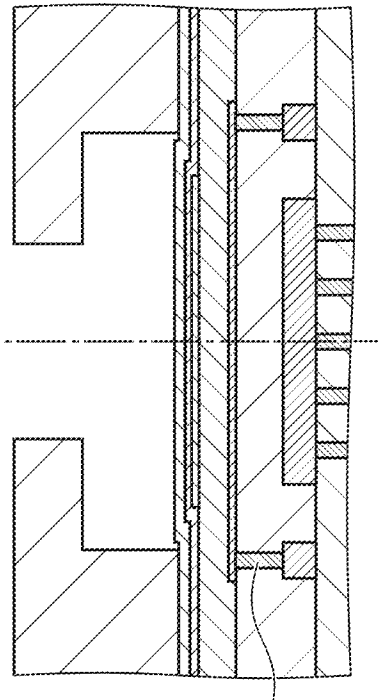
FIGS. 4A, 4B, and 4C are views each showing the multilayer wiring structure near a print element formed on a silicon substrate.
Figure 4A:
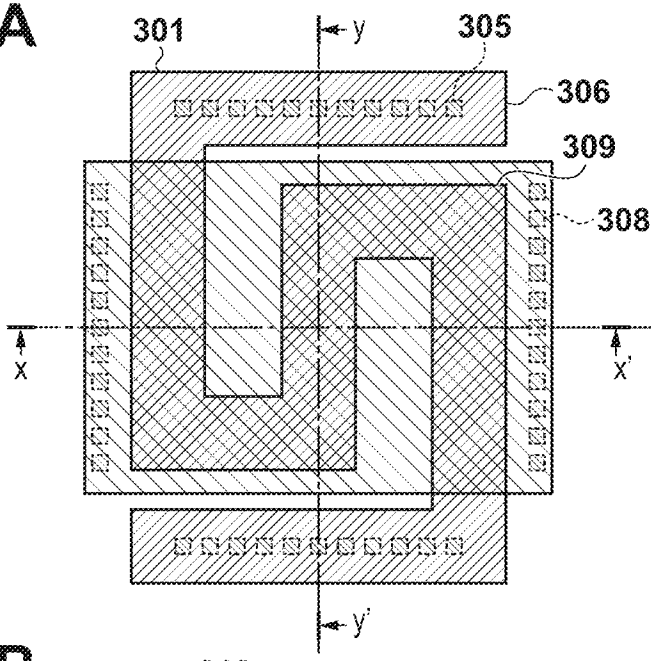
Figure 4B:
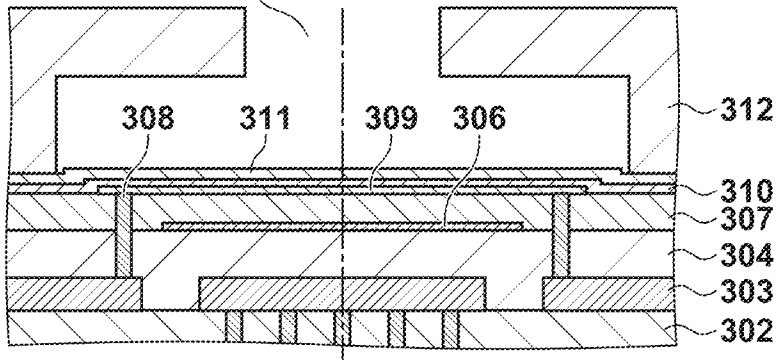

FIGS. 4A to 4C are views each showing the multilayer wiring structure near a print element formed on a silicon substrate.

FIG. 4A is a plan view showing a state in which a temperature detection element 306 is arranged in the form of a sheet in a layer below a print element 309 via an interlayer insulation film 307. FIG. 4B is a sectional view taken along a broken line x-x' in the plan view shown in FIG. 4A. FIG. 4C is a sectional view taken along a broken line y-y' shown in FIG. 4A.

In the x-x' sectional view shown in FIG. 4B and the y-y' sectional view shown in FIG. 4C, a wiring 303 made of aluminum or the like is formed on an insulation film 302 layered on the silicon substrate, and an interlayer insulation film 304 is further formed on the wiring 303. The wiring 303 and the temperature detection element 306 serving as a thin film resistor formed from a layered film of titanium and titanium nitride or the like are electrically connected via conductive plugs 305 which are embedded in the interlayer insulation film 304 and made of tungsten or the like.

Next, the interlayer insulation film 307 is formed below the temperature detection element 306. The wiring 303 and the print element 309 serving as an electrothermal transducer formed by a tantalum silicon nitride film or the like are electrically connected via conductive plugs 308 which penetrate through the interlayer insulation film 304 and the interlayer insulation film 307, and made of tungsten or the like.

Note that when connecting the conductive plugs in the lower layer and those in the upper layer, they are generally connected by sandwiching a spacer formed by an intermediate wiring layer. When applied to this embodiment, since the film thickness of the temperature detection element serving as the intermediate wiring layer is as small as about several ten nm, the accuracy of overetching control with respect to a temperature detection element film serving as the spacer is required in a via hole process. In addition, the thin film is also disadvantageous in pattern miniaturization of a temperature detection element layer. In consideration of this situation, in this embodiment, the conductive plugs which penetrate through the interlayer insulation film 304 and the interlayer insulation film 307 are employed.

To ensure the reliability of conduction in accordance with the depths of the plugs, in this embodiment, each conductive plug 305 including one interlayer insulation film has a bore of 0.4 μm, and each conductive plug 308 in which the interlayer insulation film penetrates the two films has a larger bore of 0.6 μm.

Next, a head substrate (element substrate) is obtained by forming a protection film 310 such as a silicon nitride film, and then forming an anti-cavitation film 311 that contains tantalum or the like on the protection film 310. Furthermore, an orifice 313 is formed by a nozzle forming material 312 containing a photosensitive resin or the like.

As described above, the multilayer wiring structure in which an independent intermediate layer of the temperature detection element 306 is provided between the layer of the wiring 303 and the layer of the print element 309 is employed.

With the above arrangement, in the element substrate used in this embodiment, it is possible to obtain, for each print element, temperature information by the temperature detection element provided, in correspondence with each print element, immediately below the print element.

Based on the temperature information detected by the temperature detection element and a change in temperature, a logic circuit provided in the element substrate can obtain a determination result signal RSLT indicating the status of ink discharge from the corresponding print element. The determination result signal RSLT is a 1-bit signal, and "1" indicates normal discharge and "0" indicates a discharge failure.

In general, it is known that a certain amount of variations occurs in film thickness of the temperature detection element 306 which is a thin film resistor at the time of manufacturing the thin film register as an industrial product, and thus variations occur in temperature detection sensitivity between a plurality of temperature detection elements due to a difference in resistance value caused by the variations in film thickness. Similarly, the distribution of nozzle diameters is generated due to manufacturing variations of the orifices 313 made of the nozzle forming material 312, which is one of factors of generating the distribution of temperature detection sensitivities.

<Explanation of Temperature Detection Arrangement (FIG. 5)>

Figure 5:
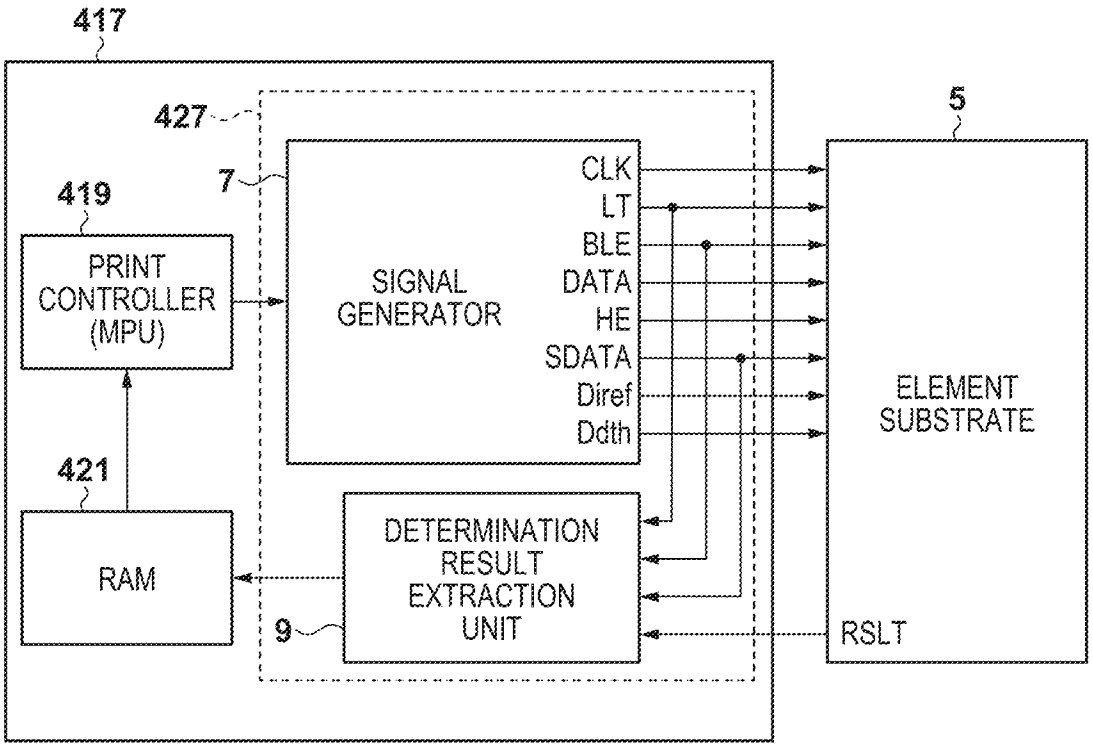
FIG. 5 is a block diagram showing a temperature detection control arrangement using the element substrate shown in FIGS. 4A to 4C.

FIG. 5 is a block diagrams showing a temperature detection control arrangement using the element substrate shown in FIGS. 4A to 4C.

As shown in FIG. 5, to detect the temperature of the print element integrated in an element substrate 5, the printer engine unit 417 includes the print controller 419 integrating the MPU, the head I/F 427 for connection to the printhead 3, and the RAM 421. Furthermore, the head I/F 427 includes a signal generator 7 that generates various signals to be transmitted to the element substrate 5, and a determination result extraction unit 9 that receives the determination result signal RSLT output from the element substrate 5 based on the temperature information detected by the temperature detection element 306.

For temperature detection, when the print controller 419 issues an instruction to the signal generator 7, the signal generator 7 outputs a clock signal CLK, a latch signal LT, a block signal BLE, a print data signal DATA, and a heat enable signal HE to the element substrate 5. The signal generator 7 also outputs a sensor selection signal SDATA, a constant electric current signal Diref, and a discharge inspection threshold signal Ddth.

The sensor selection signal SDATA includes selection information for selecting the temperature detection element to detect the temperature information, energization quantity specifying information to the selected temperature detection element, and information pertaining to an output instruction of the determination result signal RSLT. If, for example, the element substrate 5 is configured to implement five print element arrays each including a plurality of print elements, the selection information included in the sensor selection signal SDATA includes array selection information for specifying an array and print element selection information for specifying a print element of the array. On the other hand, the element substrate 5 outputs the 1-bit determination result signal RSLT based on the temperature information detected by the temperature detection element corresponding to the one print element of the array specified by the sensor selection signal SDATA.

Each of a value of "1" indicating normal discharge and a value of "0" indicating a discharge failure, which is output from the judgment result signal RSLT, is obtained by comparing, in the element substrate 5, temperature information output from the temperature detection element with a discharge inspection threshold voltage (TH) indicated by the discharge inspection threshold signal Ddth. This comparison processing will be described in detail later.

Note that this embodiment employs an arrangement in which the 1-bit determination result signal RSLT is output for the print elements of the five arrays. Therefore, in an arrangement in which the element substrate 5 implements 10 print element arrays, the determination result signal RSLT is a 2-bit signal, and this 2-bit signal is serially output to the determination result extraction unit 9 via one signal line.

As is apparent from FIG. 5, the latch signal LT, the block signal BLE, and the sensor selection signal SDATA are fed back to the determination result extraction unit 9. On the other hand, the determination result extraction unit 9 receives the determination result signal RSLT output from the element substrate 5 based on the temperature information detected by the temperature detection element, and extracts a determination result during each latch period in synchronism with the fall of the latch signal LT. If the determination result indicates a discharge failure, the block signal BLE and the sensor selection signal SDATA corresponding to the determination result are stored in the RAM 421.

The print controller 419 erases a signal for the discharge failure nozzle from the print data signal DATA of a corresponding block based on the block signal BLE and the sensor selection signal SDATA which have been used to drive the discharge failure nozzle and stored in the RAM 421. The print controller 419 adds a nozzle for complementing non-discharge to the print data signal DATA of the corresponding block instead, and outputs the signal to the signal generator 7.

<Explanation of Discharge Status Judgment Method (FIGS. 6 to 8C)>

Figure 6:
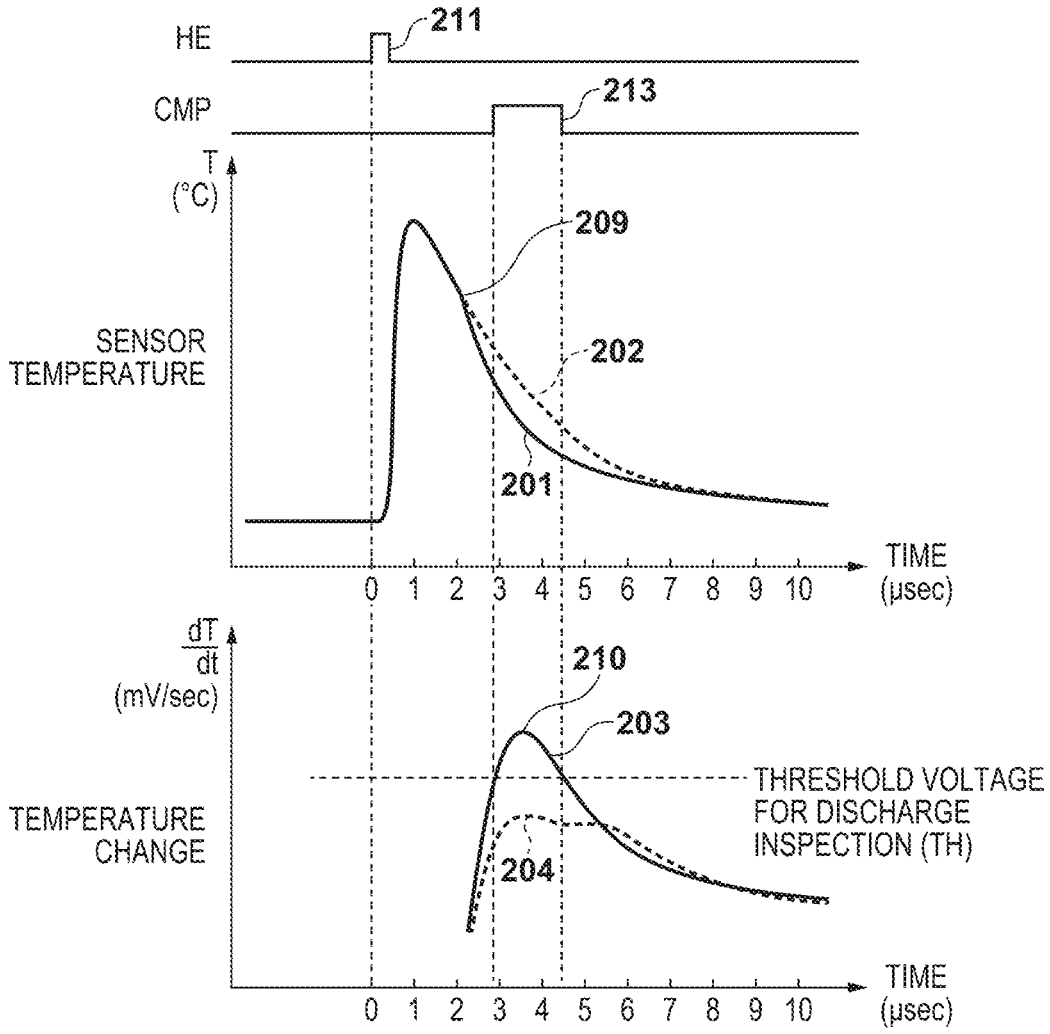
FIG. 6 is a view showing a temperature waveform output from a temperature detection element and a temperature change signal of the waveform when applying a driving pulse to the print element.

FIG. 6 is a view showing a temperature waveform (sensor temperature: T) output from the temperature detection element and a temperature change signal (dT/dt) of the waveform when applying a driving pulse to the print element.

Note that in FIG. 6, the temperature waveform (sensor temperature: T) is represented by a temperature of centigrade degrees (° C.). In fact, a constant current is supplied to the temperature detection element and a voltage (V) between the terminals of the temperature detection element is detected. Since this detected voltage has temperature dependence, the detected voltage is converted into a temperature and represented as the temperature in FIG. 6. The temperature change signal (dT/dt) is represented as a temporal change (mV/sec) in detected voltage.

As shown in FIG. 6, if ink is discharged normally when a driving pulse 211 is applied to the print element 309 (normal discharge), a waveform 201 is obtained as the output waveform of the temperature detection element 306. In a temperature drop process of the temperature detected by the temperature detection element 306, which is represented by the waveform 201, a feature point 209 appears when the tail of a discharged ink droplet is pulled back to land on the interface (outermost surface) of the print element 309 at the time of normal discharge and cools the interface of the print element 309. After the feature point 209, the waveform 201 indicates that the temperature drop rate increases abruptly. On the other hand, at the time of a discharge failure, a waveform 202 is obtained as the output waveform of the temperature detection element 306. Unlike the waveform 201 at the time of normal discharge, no feature point 209 appears, and the temperature gradually decreases in a temperature drop process.

The lowermost timing chart of FIG. 6 shows the temperature change signal (dT/dt), and a waveform 203 or 204 represents a waveform obtained after processing the output waveform 201 or 202 of the temperature detection element into the temperature change signal (dT/dt). A method of performing conversion into the temperature change signal at this time is appropriately selected in accordance with a system. The temperature change signal (dT/dt) according to this embodiment is represented by a waveform output after the temperature waveform is processed by a filter circuit (one differential operation in this arrangement) and an inverting amplifier.

In the waveform 203, a peak 210 derived from the highest temperature drop rate after the feature point 209 of the waveform 201 appears. The waveform (dT/dt) 203 is compared with a discharge inspection threshold voltage (TH) preset in a comparator integrated in the element substrate 5, and a pulse indicating normal discharge in a section (dT/dt≥TH) in which the waveform 203 exceeds the discharge inspection threshold voltage (TH) appears in a judgment signal (CMP) 213.

On the other hand, since no feature point 209 appears in the waveform 202, the temperature drop rate is low, and the peak appearing in the waveform 204 is lower than the discharge inspection threshold voltage (TH). The waveform (dT/dt) 202 is also compared with the discharge inspection threshold voltage (TH) preset in the comparator integrated in the element substrate 5. In a section (dT/dt<TH) in which the waveform 202 is below the discharge inspection threshold voltage (TH), no pulse appears in the judgment signal 213.

Therefore, by obtaining this judgment signal (CMP), it is possible to grasp the discharge status of each nozzle. This judgment signal (CMP) serves as the above-described judgment result signal RSLT.

The main body portion of the printing apparatus can differentiate between normal discharge and non-discharge by presetting the discharge judgment threshold voltage (TH) between a value (Def) corresponding to the voltage of the peak 210 of the temperature change signal (dT/dt) at the time of normal discharge and that at the time of non-discharge.

A method of measuring the value (Dref) corresponding to the voltage of the peak 210 of the temperature change signal (dT/dt) 203 of each nozzle by the main body portion of the printing apparatus will be described next.

Figure 7:
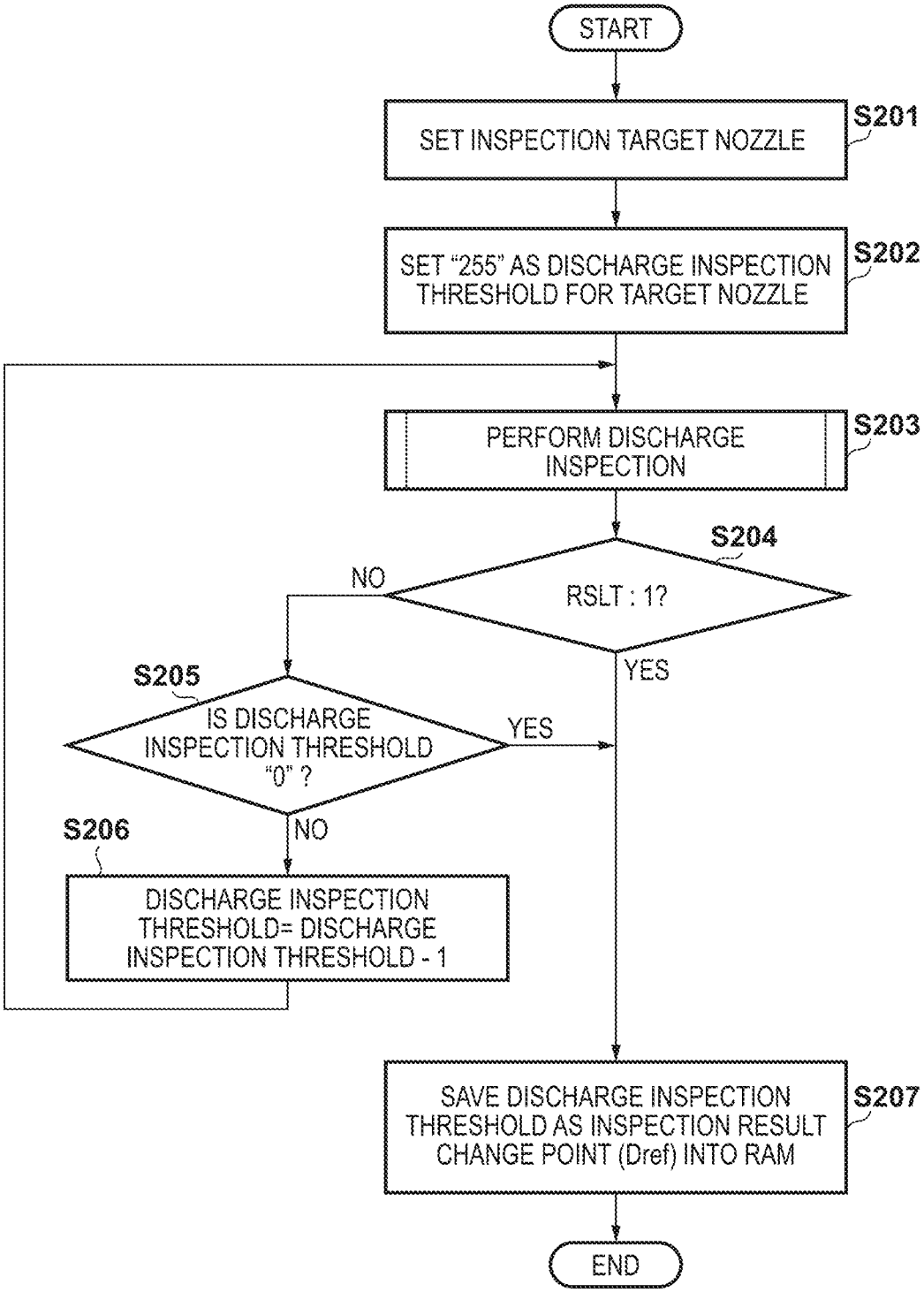
FIG. 7 is a flowchart illustrating a method of measuring a value Dref of each nozzle.

FIG. 7 is a flowchart illustrating the method of measuring the value Dref of each nozzle.

In step S201, a target nozzle of the reset of the discharge inspection threshold is set. Next, in step S202, the discharge inspection threshold voltage (TH) of the target nozzle is set to "255".

The discharge inspection threshold voltage (TH) is compared with the temperature change (dT/dt) of the detected temperature output from the temperature detection element 306. The value of this temperature change is physically expressed in a unit of mV/sec. In this embodiment, however, this value is quantumly expressed by 8 bits. Thus, "255" as the maximum value of the 8-bit representation is temporarily set as the value of the discharge inspection threshold voltage (TH).

In step S203, discharge inspection is executed using the set discharge inspection threshold voltage (TH). In step S204, the judgment result signal RSLT of the selected nozzle is checked based on the set discharge inspection threshold voltage (TH). If the value of the judgment result signal RSLT is "1", the process advances to step S207. If the value of the judgment result signal RSLT is "0", the process advances to step S205.

In step S205, it is checked whether the discharge inspection threshold voltage (TH) is "0", that is, the minimum value. If the discharge inspection threshold voltage (TH) is "0", the process advances to step S207; otherwise, the process advances to step S206, and the value of the discharge inspection threshold voltage (TH) is decremented by "−1". Then, the process returns to step S203.

As described above, in the processes of steps S203 to S206, discharge inspection is repeated for one selected nozzle while changing the value of the discharge inspection threshold voltage (TH) stepwise, thereby specifying the inspection result change point at which the judgment result signal RSLT changes from "0" to "1". The inspection result change point is synonymous with the value (Dref) of the peak of the temperature change signal (dT/dt). In step S207, the value of the discharge inspection threshold voltage (TH) corresponding to the inspection result change point is temporarily saved in the RAM 421.

By executing the above processing for all the nozzles at any desired timing, it is possible to measure the value (Dref) corresponding to the voltage of the peak 210 of the temperature change signal (dT/dt) 203 of each nozzle.

Note that FIG. 7 has exemplified the processing of decreasing the discharge inspection threshold (TH) stepwise by "−1" from 255 until the inspection result changes. However, the present invention is not limited to this, and the discharge inspection threshold (TH) can be set appropriately in accordance with a system. For example, the currently held value Dref may be set as the discharge inspection threshold (TH), and the discharge inspection threshold (TH) may be increased/decreased in accordance with an inspection result, thereby performing processing. This method can specify the inspection result change point more quickly, and is thus desirable from the viewpoint of the processing time.

In addition, the value (Dref) corresponding to the voltage of the peak 210 of the temperature change signal (dT/dt) 203 of each nozzle changes depending on the discharge status such as the discharge failure status caused by an increase in ink viscosity in the nozzle and adhesion of paper dust of a print medium or dust in the air. It is, therefore, desirable to update the value (Dref) corresponding to the voltage of the peak 210 at each predetermined timing. The predetermined timing is set by a paper feeding count, a print dot count, time, an elapsed period after last inspection, a timing for each print job, a timing for each print page, a timing of replacement of the printhead, a timing of recovery processing of the printhead, or the like, and is set appropriately in accordance with a system.

Problem of Judgment of Discharge Status

Figures 8A, 8B, 8C:
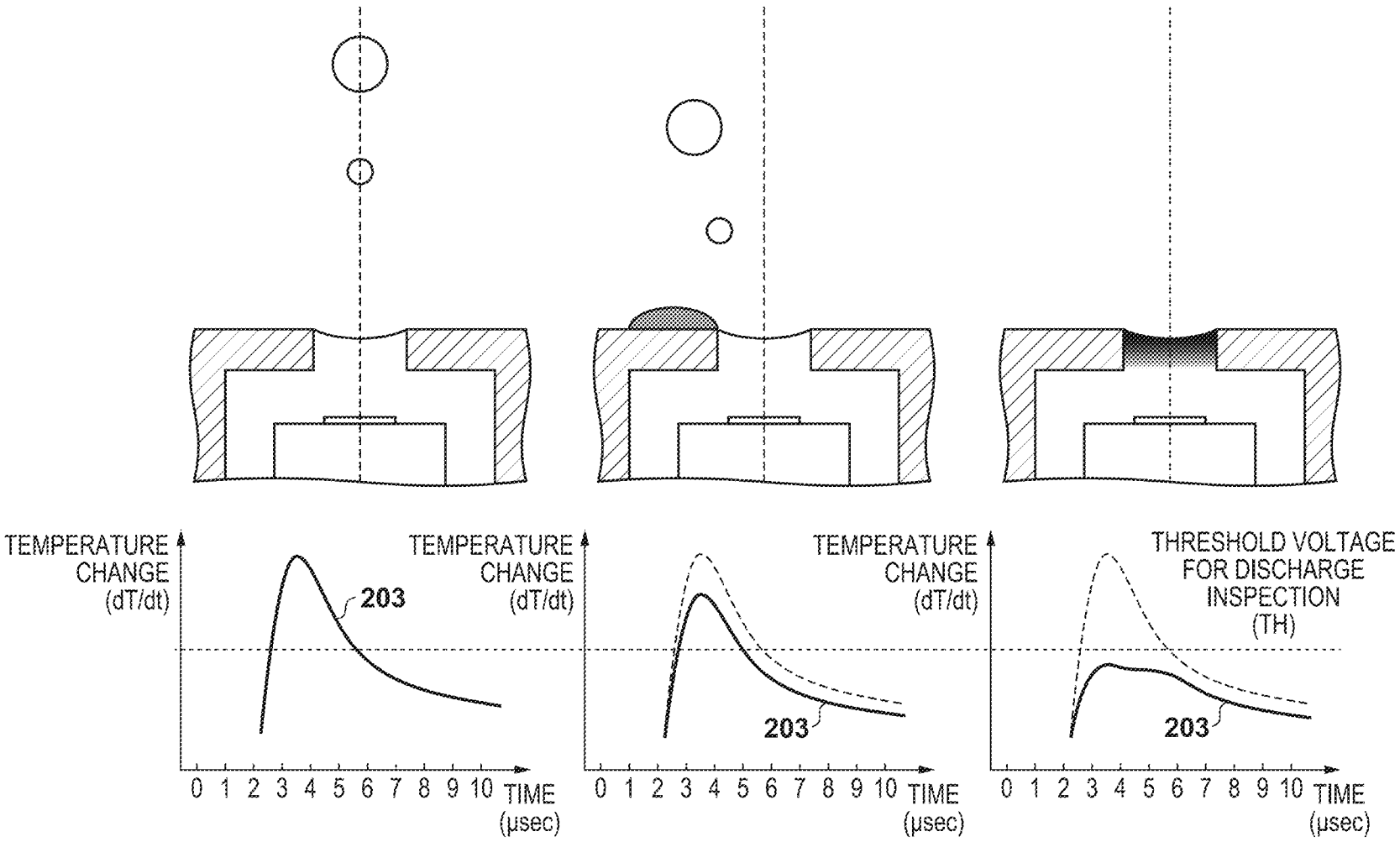
FIGS. 8A, 8B, and 8C comprise schematic views of three discharge statuses, and timing charts each showing the waveform of a temperature change signal (dT/dt) based on a temperature waveform signal detected by the temperature detection element at this time.

FIGS. 8A to 8C show schematic views of nozzle portions in three discharge statuses and discharged ink droplets, and timing charts each showing the waveform of the temperature change signal (dT/dt) based on the temperature waveform signal detected by the temperature detection element in each status.

FIG. 8A includes the schematic view of the discharge status when ink is normally discharged, and the timing chart showing the profile of the temperature change. The discharge inspection threshold voltage (TH) is set low with respect to the peak of the waveform 203 at the time of normal discharge. Therefore, the discharge status can be discriminated as the normal discharge status by comparing the discharge inspection threshold voltage (TH) and the temperature change signal (dT/dt) with each other.

FIG. 8B includes the schematic view when an ink droplet is adhered to the orifice surface and the status of straightness of flight of a discharged ink droplet is poor, and the timing chart showing the profile of the temperature change. Since the flight trajectory of the discharged ink droplet is poor in straightness, a position at which the ink droplet reaches the print medium is deviated from an intended position, and stripes or dark stripes around them are perceived, thereby degrading the image quality. This phenomenon occurs not only due to adherence of an ink droplet to the orifice surface but also various factors such as adherence of paper dust derived from the print medium and dust floating in the air. In this status, it is necessary to clean the orifice surface by maintenance processing.

In the waveform 203 at this time, the straightness of the discharged ink droplet is not sufficient but a foaming phenomenon occurs due to heating on the heater. Thus, the temperature change signal of a certain level is output. However, as shown in FIG. 8B, the peak value is lower than the peak value of the waveform 203 (a dotted line in FIG. 8B) obtained at the time of normal discharge shown in FIG. 8A. It is considered that this is because flight of the discharge ink is influenced by a foreign substance on the orifice surface and the amount of the tail of the discharged ink droplet changes.

However, the change amount from the waveform 203 (the dotted line in FIG. 8B) obtained at the time of normal discharge is often smaller than a variation in temperature detection sensitivity of the above-described temperature detection element 306 which is a thin film resistor. Therefore, the discharge inspection threshold voltage (TH) is set low with respect to the peak of the waveform in this status, and the discharge status is discriminated as the normal discharge status by comparing the discharge inspection threshold voltage (TH) and the temperature change signal (dT/dt) with each other.

FIG. 8C includes the schematic view when no ink droplet is discharged due to an increase in ink viscosity in the nozzle of the printhead or fixation of ink, and the timing chart showing the profile of the temperature change. Since no ink droplet is discharged, there is no ink droplet at an intended position on the print medium, and stripes are perceived, thereby degrading the image quality. In this status, it is necessary to remove ink with increased viscosity in the nozzle or ink fixed to the orifice surface by maintenance processing. In this case, recovery is possible by the above-described vacuum wiping processing but a consumed ink amount is large. In this embodiment, it is possible to recover the nozzle status by executing an ink circulation operation and continuously supplying fresh ink into the nozzle for a predetermined period to dissolve ink with increased viscosity or fixed ink without consuming ink.

The change amount from the waveform 203 at the time of normal discharge is sufficiently larger than a variation in temperature detection sensitivity of the above-described temperature detection element 306 which is a thin film resistor, and the discharge inspection threshold voltage (TH) is set high with respect to the peak of the waveform 203 in this status. Therefore, the discharge status is discriminated as the discharge failure status by comparing the discharge inspection threshold voltage (TH) and the temperature change signal (dT/dt) with each other. Note that in FIG. 8C as well, the waveform at the time of normal discharge is indicated by a dotted line for the reference purpose.

As shown in FIGS. 8A to 8C, the peak value of the temperature change signal (dT/dt) is different in accordance with the normal discharge status, the discharge failure status, or the non-discharge status. Therefore, if judgement of the discharge status is executed, the following judgment result signal RSLT is output by performing comparison with the discharge judgment threshold voltage (TH). That is, judgment result signal RSLT "1" for FIG. 8A,
judgment result signal RSLT "1" for FIG. 8B, and
judgment result signal RSLT "0" for FIG. 8C.

In this case, a nozzle for which the judgment result signal RSLT "1" is judged may be in the normal discharge status or the discharge failure status, and a nozzle for which the judgment result signal RSLT "0" is judged is in the non-discharge status. When it is impossible to discriminate between the normal discharge status and the discharge failure status, recovery processing cannot be executed at an appropriate timing, and thus an image failure such as stripes may occur.

If the actual discharge status is the discharge failure status caused by adherence of an ink droplet to the orifice surface, it is necessary to execute wiping of the orifice surface by blade wiping after executing discharge inspection. However, since the judgment result according to this method indicates the possibility of the normal discharge status or the discharge failure status, it is difficult to determine whether a discharge failure has actually occurred and a timing at which recovery processing should be executed.

Furthermore, if blade wiping processing is executed at each predetermined timing (for example, every predetermined number of fed paper sheets) since the discharge failure status cannot be detected, the blade wiping processing is executed regardless of the actual discharge status, resulting in insufficient or excessive recovery processing. As a result, the quality of the printed image is degraded, and wasteful recovery processing time occurs.

As described above, the above-described judgment method also assumes that when executing processing according to the discharge inspection judgment result, it is difficult to discriminate between the normal discharge status and the discharge failure status and recovery processing at an appropriate timing cannot be selected. Embodiments to be described below will explain arrangements and control operations for solving the above problem.

First Embodiment

With reference to a flowchart and a schematic view, this embodiment will describe a method of discriminating between the normal discharge status and the discharge failure status which are difficult to be discriminated by the method according to the above-described example.

Figure 9:
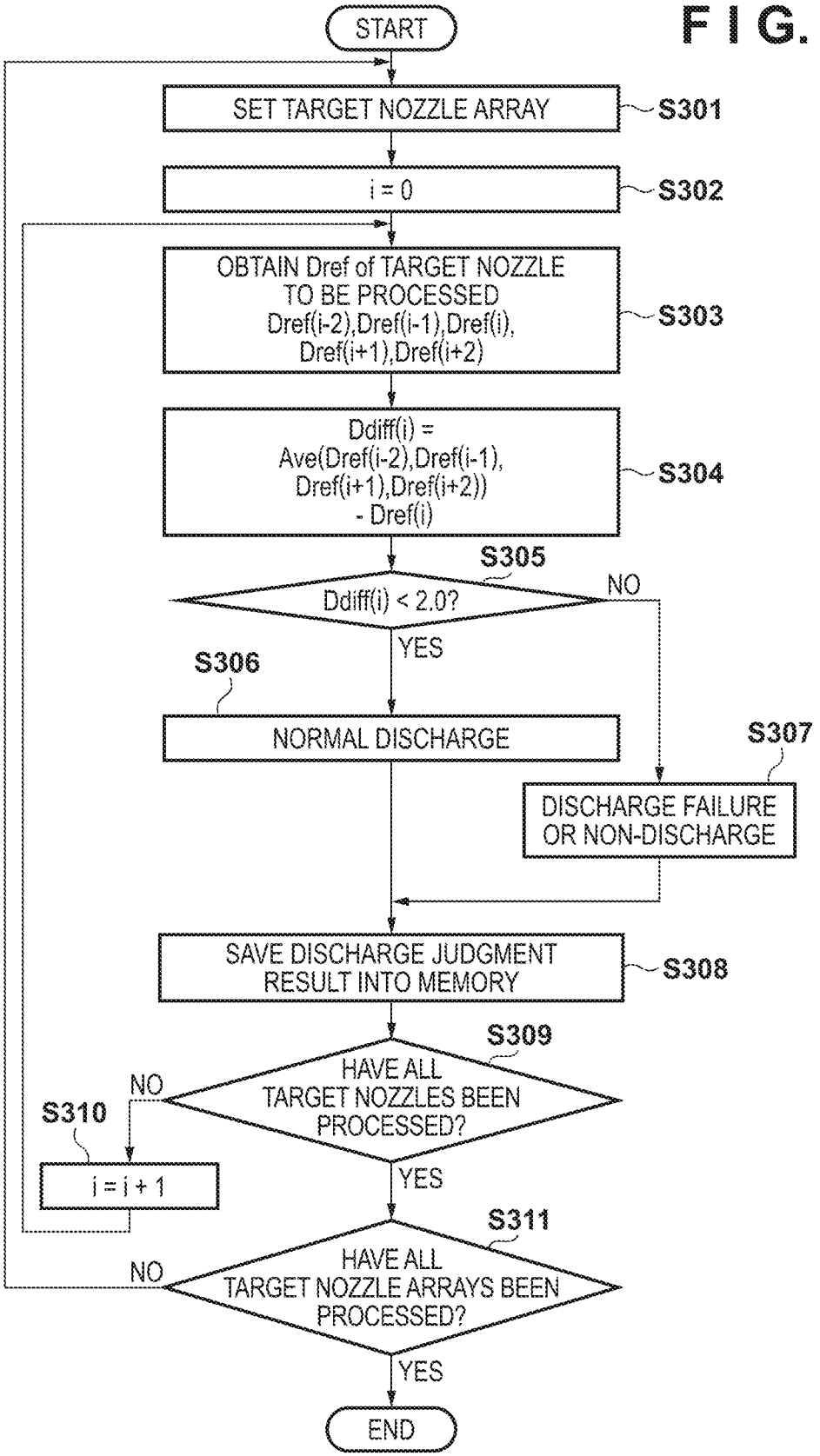
FIG. 9 is a flowchart illustrating processing of discriminating the status of ink discharge from a nozzle according to the first embodiment.

FIG. 9 is a flowchart illustrating processing of discriminating the status of ink discharge from a nozzle according to the first embodiment.

In step S301, a nozzle array of the printhead is set as a processing target. In step S302, a nozzle number within the target nozzle array is represented by i, and i=0 is set to start the processing from seg 0.

In step S303, the values Dref of the processing target nozzle and its adjacent nozzles are obtained. Note that in this embodiment, the number of adjacent nozzles is two. That is, the values Dref of the processing target nozzle and two nozzles on each side of the processing target nozzle, that is, five nozzles in total are obtained. For example, if the processing target nozzle is seg 8, its adjacent nozzles are seg 6, seg 7, seg 9, and seg 10. The number of adjacent nozzles is not limited to this, and is appropriately set in accordance with a system. The latest values Dref are held in the memory (RAM 421) by executing, at any desired timing, the processing described with reference to FIG. 7. For two nozzles at each end of the nozzle array, the values Dref for five nozzles cannot be obtained, and appropriate processing cannot be performed. Thus, the nozzles are excluded from the targets of this processing.

In step S304, the difference value Ddiff between the value Dref of the processing target nozzle and a value obtained by statistics of the values Dref of the adjacent nozzles is calculated. In the following description, the average value of the values Dref of the adjacent nozzles is used as the value obtained by statistics of the values Dref of the adjacent nozzles. Subsequently, in step S305, the value Ddiff calculated in step S304 is compared with a predetermined threshold. In this embodiment, the predetermined threshold is set to "2.0". If Ddiff<2.0 is satisfied, the process advances to step S306, and the normal discharge status is judged; otherwise, the process advances to step S307, and the discharge failure or non-discharge status is judged. Even if either result is judged, the process advances to step S308, and the judgment result is saved in the main body memory (RAM 421). Note that as the above-described value obtained by statistics of the values Dref of the adjacent nozzles, a median or a mode can be used instead of the average value of the values Dref of the adjacent nozzles, thereby performing processing to be described below.

In step S309, it is checked whether judgment has been performed for all processing target nozzles. If there is a processing target nozzle for which judgment has not ended, the process advances to step S310, and the processing target nozzle is changed to the next nozzle. Then, the process returns to step S303 and the above-described processes are repeated. On the other hand, if judgment has ended for all the processing target nozzles in the nozzle array, the process advances to step S311, and it is checked whether judgment has ended for all processing target nozzle arrays.

If there is a processing target nozzle array for which judgment has not ended, the process returns to step S301 and the target nozzle array is set, thereby repeating the above-described processes. On the other hand, if judgment has ended for all the processing target nozzle arrays, the processing ends.

Figure 10A:
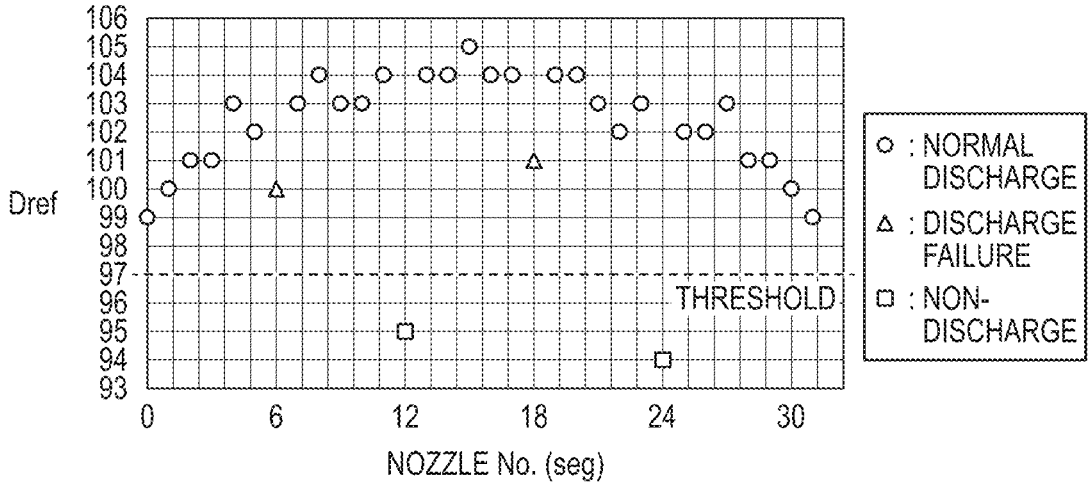
FIGS. 10A and 10B are views respectively showing the value Dref and a calculated value Ddiff of each nozzle judged to be in a normal discharge status, a discharge failure status, or a non-discharge status.
Figure 10B:
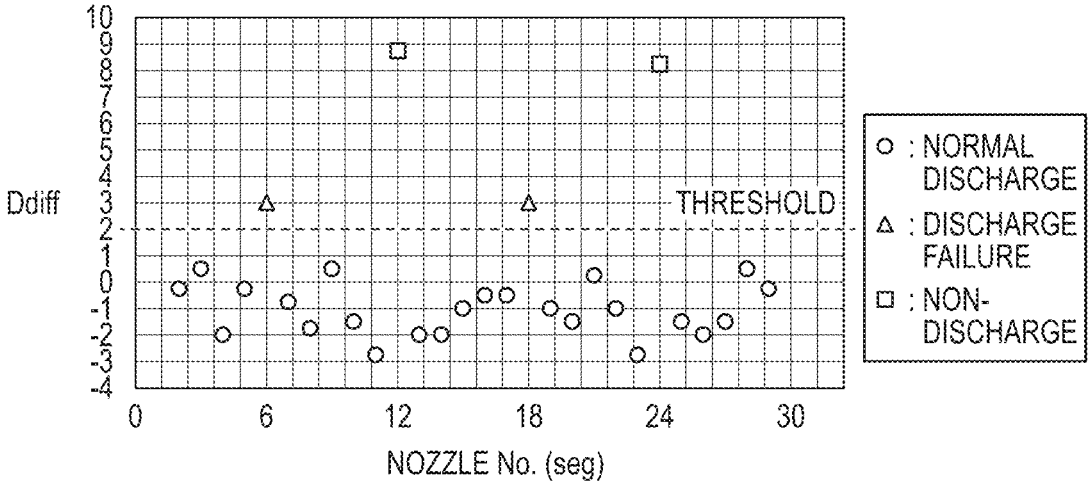

FIGS. 10A and 10B are views respectively showing the value Dref and the calculated value Ddiff of each nozzle judged to be in the normal discharge status, the discharge failure status, or the non-discharge status. Note that in FIGS. 10A and 10B, ○ represents a nozzle judged to be in the normal discharge status, Δ represents a nozzle judged to be in the discharge failure status, and □ represents a nozzle judged to be in the non-discharge status.

A method of discriminating each discharge status will be described next with reference to FIGS. 10A and 10B.

FIG. 10A shows temperature change information (the value Dref) of each nozzle. In this example, the printhead 3 includes 32 nozzles (seg 0 to seg 31), and the discharge statuses of the respective nozzles are different. As described above, the detected temperature change signal (Dref) is different for each of the normal discharge status, the discharge failure status caused by ink adhered to the orifice surface, and the non-discharge status caused by ink fixed to the nozzle. In the example shown in FIG. 10A, it is indicated that the nozzles (seg 6 and seg 18) are in the discharge failure status, and the nozzles (seg 12 and seg 24) are in the non-discharge status.

Even for the nozzles judged to be in the normal discharge status, the values Dref have variations in the nozzle array, which are derived from variations of the temperature detection sensitivities of the temperature detection elements which are thin film resistors. While the width of the variations is six ranks with respect to the value Dref shown in FIG. 10A, the change of the value Dref caused by a discharge failure is small within two or three ranks. That is, if, in this status, the discharge status is to be discriminated based on a predetermined threshold, it is impossible to discriminate between the normal discharge nozzle and the discharge failure nozzle.

FIG. 10B shows the value Ddiff obtained by executing the processing shown in FIG. 9 for each nozzle in the status shown in FIG. 10A. Since the value Ddiff is the difference value between the value Dref of the processing target nozzle and the average value of the values Dref of the four adjacent nozzles, two on each side of the target nozzle, the two nozzles on each side of the nozzle array are excluded from the targets of this processing. Therefore, in FIG. 10B, the value Ddiff is not obtained for the four nozzles (seg 0, seg 1, seg 30, and seg 31), two on each side, and is not displayed.

As described above, even for the nozzles judged to be in the normal discharge status, the values Dref have variations in the nozzle array, which are derived from variations of the temperature detection sensitivities of the temperature detection elements which are thin film resistors. The variations are extremely small between adjacent nozzles, as shown in FIG. 10A. It is assumed that this is derived from a high degree of coincidence of processing conditions, at the time of manufacturing, of elements close to each other, as compared with elements far from each other. Therefore, it is considered that variations of temperature detection sensitivities are small between the temperature detection element corresponding to the processing target nozzle and that corresponding to the nozzle close to the processing target nozzle. Thus, the values Ddiff of the nozzles judged to be in the normal discharge status are distributed around zero, as shown in FIG. 10B (o in FIG. 10B). Therefore, it is possible to specify the nozzle whose value Dref changes due to a discharge failure or non-discharge by estimating the original value Dref of the processing target nozzle from the values Dref of the plurality of adjacent nozzles and performing comparison. It is preferable to use the adjacent nozzles in the terms of this point.

The mode of estimating the original value Dref of the processing target nozzle from the values Dref of the plurality of adjacent nozzles and performing comparison has been exemplified above. However, based on the above-described viewpoint, it is possible to estimate the original value Dref of the processing target nozzle using the values Dref of other close nozzles without using the adjacent nozzles of the processing target nozzle, and perform comparison. For example, in step S304, the difference value between the value Dref of the processing target nozzle and a value obtained by statistics of the values Dref of the nozzles close to the processing target nozzle can be calculated as Ddiff and then the following processes can be performed. Note that the range of closeness can appropriately be set in consideration of variations of characteristics of respective positions within the element substrate. For example, a range from the processing target nozzle to 150 μm on each side can be set as the range of closeness. Then, a value obtained by statistics of the values Dref of, for example, four nozzles among nozzles within the range can be used. If the in-plane uniformity of the element substrate is high and variations of the characteristics of the respective temperature detection elements are suppressed extremely small, the range of closeness may further be widened.

That is, as shown in FIG. 10B, it is possible to discriminate a nozzle whose value Ddiff exceeds a threshold (Ddiff_TH) of 2.0 to be in the discharge failure status (Δ in FIG. 10B) or the non-discharge status (□ in FIG. 10B). If, for example, the processing target nozzle is seg 9, the average value of the values Dref of the adjacent nozzles (seg 7, seg 8, seg 10, and seg 11) is 103.5 and the value Dref of the nozzle (seg 9) is 103. Thus, the value Ddiff is +0.5, and the nozzle is judged as a normal discharge nozzle. If the processing target nozzle is seg 6, the average value of the values Dref of the adjacent nozzles (seg 4, seg 5, seg 7, and seg 8) is 103.0 and the value Dref of seg 6 is 100. Thus, the value Ddiff is +3.0, and the nozzle is judged as a discharge failure nozzle or a non-discharge nozzle.

Therefore, according to the above-described embodiment, it is possible to classify each nozzle into one of two discharge statuses of the normal discharge status and the discharge failure or non-discharge status by calculating the value Ddiff from the values Dref of the nozzles and comparing it with the threshold. This can detect a nozzle in the discharge failure status, and execute recovery processing such as blade wiping at an appropriate timing.

Note that it is possible to cancel a repeatability error of the value Dref of each nozzle by sampling the value Dref of each nozzle a plurality of times, and setting the average value of the obtained values as the value Dref, thereby judging the discharge status more accurately.

Second Embodiment

The first embodiment has explained the method of classifying each nozzle into one of the two discharge statuses of the normal discharge status, and the discharge failure or non-discharge status. In this embodiment, a method of discriminating three statuses of the normal discharge status, the discharge failure status, and the non-discharge status will be described. Note that a basic processing procedure is the same as in the first embodiment, and only a characteristic arrangement of this embodiment will be described here.

Figure 11:
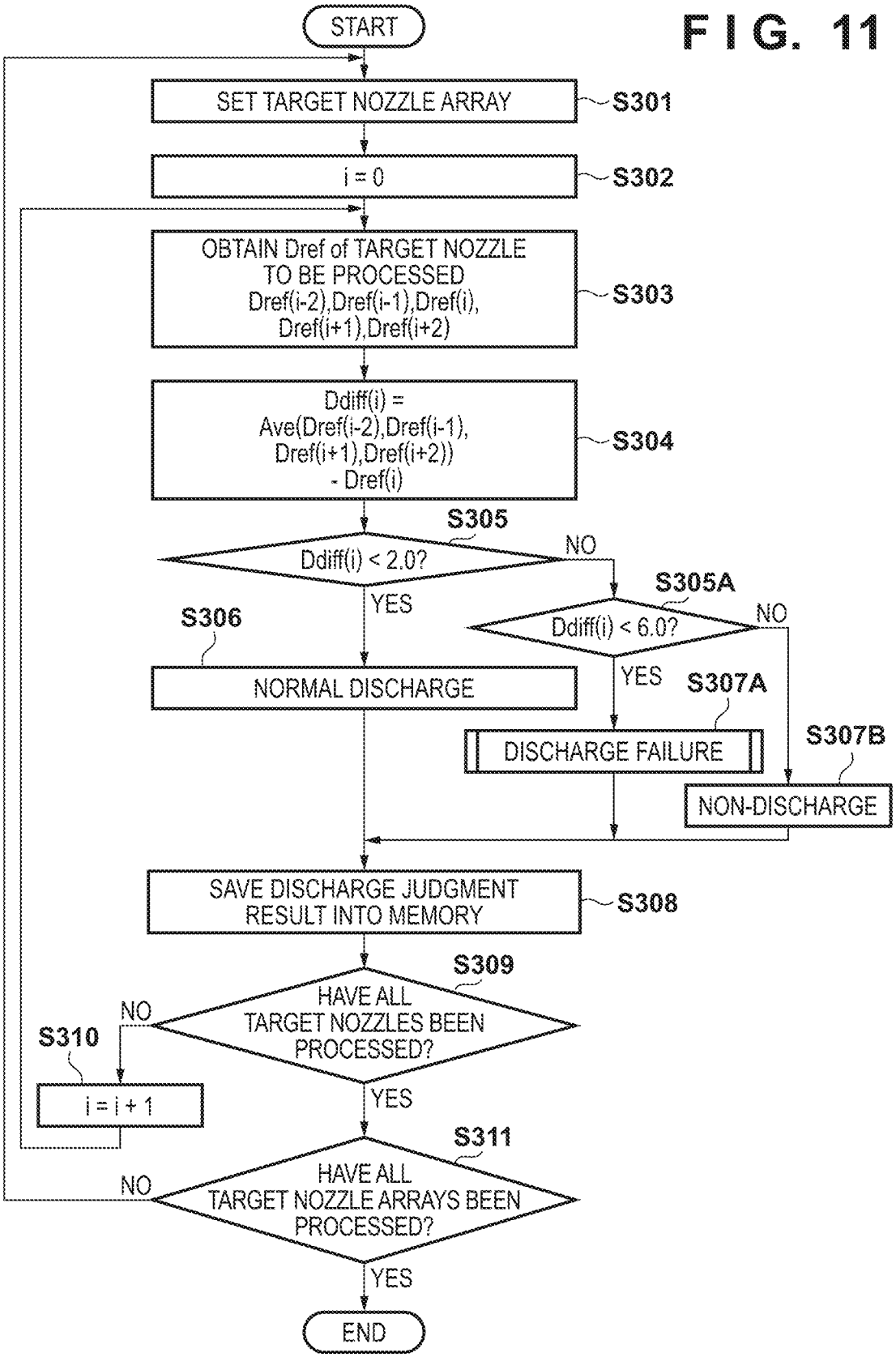
FIG. 11 is a flowchart illustrating processing of discriminating among three statuses of ink discharge from a nozzle according to the second embodiment.

FIG. 11 is a flowchart illustrating processing of discriminating the three statuses of ink discharge from a nozzle according to the second embodiment. Note that in FIG. 11, the same step numbers as those described with reference to FIG. 9 denote the same processing steps and a description thereof will be omitted.

In this embodiment, similar to the first embodiment, after executing the processes in steps S301 to S304, the value Ddiff of the target nozzle is compared with a predetermined threshold (first threshold: Ddiff_TH1) in step S305. In this embodiment, the predetermined threshold is set to "2.0". If Ddiff<2.0 is satisfied (that is, Ddiff is smaller than the first threshold), the process advances to step S306, and the normal discharge status is judged. If Ddiff≥2.0 is satisfied (that is, Ddiff is equal to or larger than the first threshold), the process advances to step S305A.

In step S305A, the value Ddiff of the target nozzle is compared with another predetermined threshold (second threshold: Ddiff_TH2). In this embodiment, the other predetermined threshold is set to "6.0". If Ddiff<6.0 is satisfied (that is, Ddiff is smaller than the second threshold), the process advances to step S307A, and the discharge failure status is judged. If Ddiff≥6.0 is satisfied (that is, Ddiff is equal to or larger than the second threshold), the process advances to step S307B, and the non-discharge status is judged.

Even if any of the results of steps S306, S307A, and S307B is judged, the process advances to step S308, and the judgment result is saved in the main body memory (RAM 421).

After that, similar to the first embodiment, the processes in steps S308 to S311 are executed.

Figure 12:
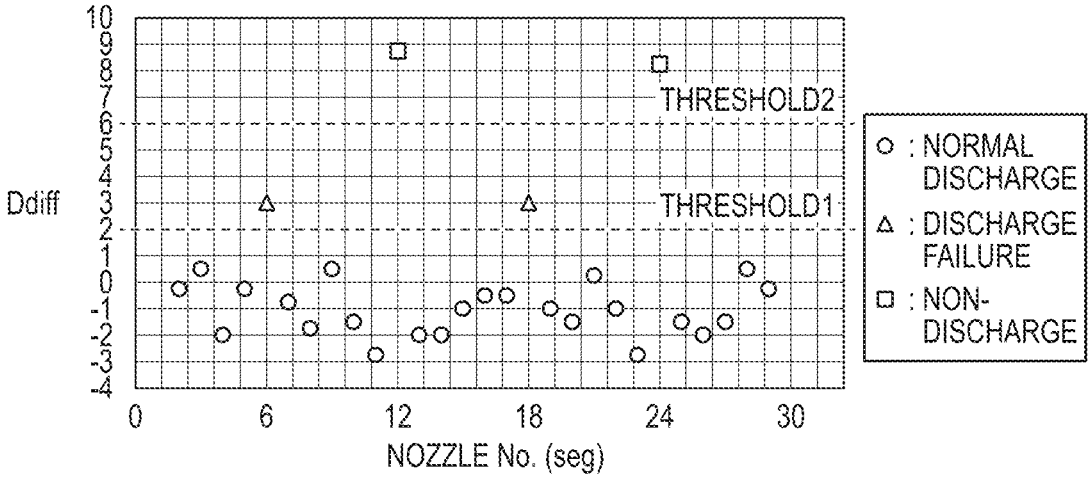
FIG. 12 is a view showing the relationship between the calculated value Ddiff and two thresholds with respect to each nozzle judged to be in the normal discharge status, the discharge failure status, or the non-discharge status.

FIG. 12 is a view showing the relationship between the calculated value Ddiff and the two thresholds with respect to each nozzle judged to be in the normal discharge status, the discharge failure status, or the non-discharge status. Note that in FIG. 12 as well, ○ represents a nozzle judged to be in the normal discharge status, Δ represents a nozzle judged to be in the discharge failure status, and □ represents a nozzle judged to be in the non-discharge status.

A method of discriminating each discharge status will be described next with reference to FIG. 12.

As shown in FIG. 12, the first threshold (Ddiff_TH1) and the second threshold (Ddiff_TH2) are set with respect to the value Ddiff of each nozzle, and the different discharge statuses respectively correspond to ranges divided by the thresholds.

In this embodiment, the first threshold (Ddiff_TH1) is set to 2.0, and the range of Ddiff≤2.0 is classified as the normal discharge status. Furthermore, the second threshold (Ddiff_TH2) is set to 6.0, and the range of 2.0<Ddiff≤6.0 is classified as the discharge failure status. For example, if the processing target nozzle is seg 9, the average value of the values Dref of the adjacent nozzles (seg 7, seg 8, seg 10, and seg 11) is 103.5 and the value Dref of the nozzle (seg 9) is 103, as shown in FIG. 10B. Therefore, the value Ddiff is +0.5 and the normal discharge status is judged.

If the processing target nozzle is seg 6, the average value of the values Dref of the adjacent nozzles (seg 4, seg 5, seg 7, and seg 8) is 103.0 and the value Dref of seg 6 is 100. Thus, referring to FIG. 12, the value Ddiff is +3.0 and the discharge failure status is judged. If the processing target nozzle is seg 12, the average value of the values Dref of the adjacent nozzles (seg 10, seg 11, seg 13, and seg 14) is 103.8 and the value Dref of seg 12 is 95. Thus, referring to FIG. 12, the value Ddiff is +8.8 and the non-discharge status is judged.

Therefore, according to the above-described embodiment, it is possible to classify each nozzle into one of the three discharge statuses of the normal discharge status, the discharge failure status, and the non-discharge status by comparing the value Ddiff with the two thresholds. This makes it possible to execute not only recovery processing at an appropriate timing but also the following processing. That is, it is possible to specify the discharge status for each nozzle, urge selective recovery by increasing a drive count for preliminary discharge for a non-discharge nozzle, and optimize the timing of blade wiping by counting only the number of discharge failure nozzles. In addition, if a non-discharge nozzle is detected, more detailed recovery processing, for example, powerful recovery processing such as suction recovery can be executed.

Third Embodiment

In the first and second embodiments, the discharge status is judged by calculating the difference of the value Dref of the processing target nozzle from the average value of the values Dref of the four adjacent nozzles. In this method, however, if the adjacent nozzles include a non-discharge nozzle, a low average value of the values Dref of the four adjacent nozzles is calculated due to the value Dref of the non-discharge nozzle, and it may be impossible to detect a discharge failure nozzle. In consideration of this, this embodiment will describe an example in which if an adjacent nozzle is a non-discharge nozzle, the discharge status of the target nozzle is judged more correctly by calculating the average value of the values Dref by excluding the value Dref of the non-discharge nozzle.

Figure 13A:
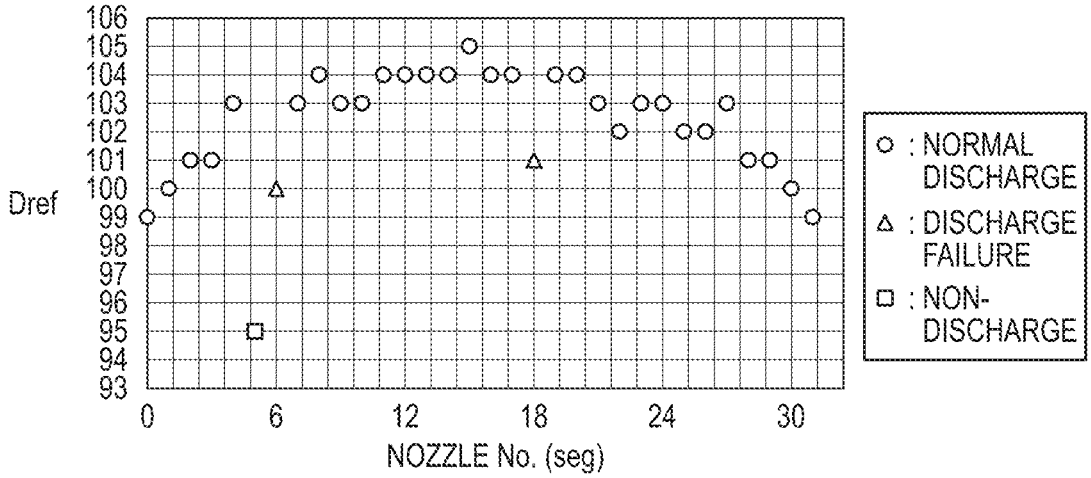
FIGS. 13A and 13B are views respectively showing the value Dref and the calculated value Ddiff of each nozzle judged to be in the normal discharge status, the discharge failure status, or the non-discharge status.
Figure 13B:
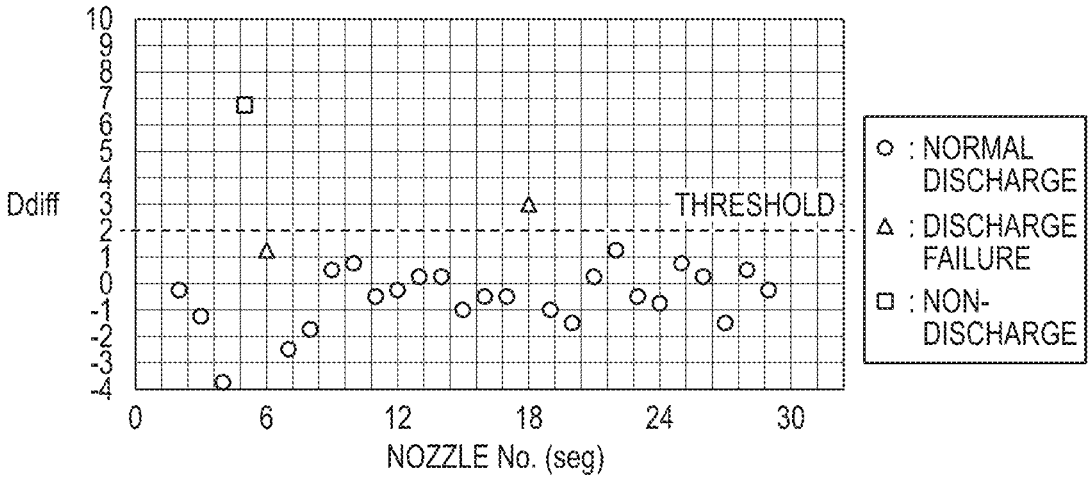

FIGS. 13A and 13B are views respectively showing the value Dref and the calculated value Ddiff of each nozzle judged to be in the normal discharge status, the discharge failure status, or the non-discharge status, similar to FIGS. 10A and 10B. Note that in FIGS. 13A and 13B, ○ represents a nozzle judged to be in the normal discharge status, Δ represents a nozzle judged to be in the discharge failure status, and □ represents a nozzle judged to be in the non-discharge status. The value Ddiff shown in FIG. 13B is calculated in the same method as that described in the first or second embodiment.

Referring to FIG. 13A, if the processing target nozzle is seg 6, the average value of the values Dref of the four adjacent nozzles (seg 4, seg 5, seg 7, and seg 8) is 101.3, the value Dref of the nozzle (seg 6) is 100, and thus the value Ddiff is +1.3. Therefore, as shown in FIG. 13B, the processing target nozzle is judged to be in the normal discharge status. However, since the nozzle (seg 6) is actually in the discharge failure status, erroneous judgment is performed. This is caused by the fact that an adjacent nozzle (in this case, seg 5) of the processing target nozzle is in the non-discharge status that indicates a low value Dref, and thus the average value of the values Dref of the four adjacent nozzles is calculated smaller than that described in the first or second embodiment.

Processing for avoiding this situation will be described next.

Figure 14A:
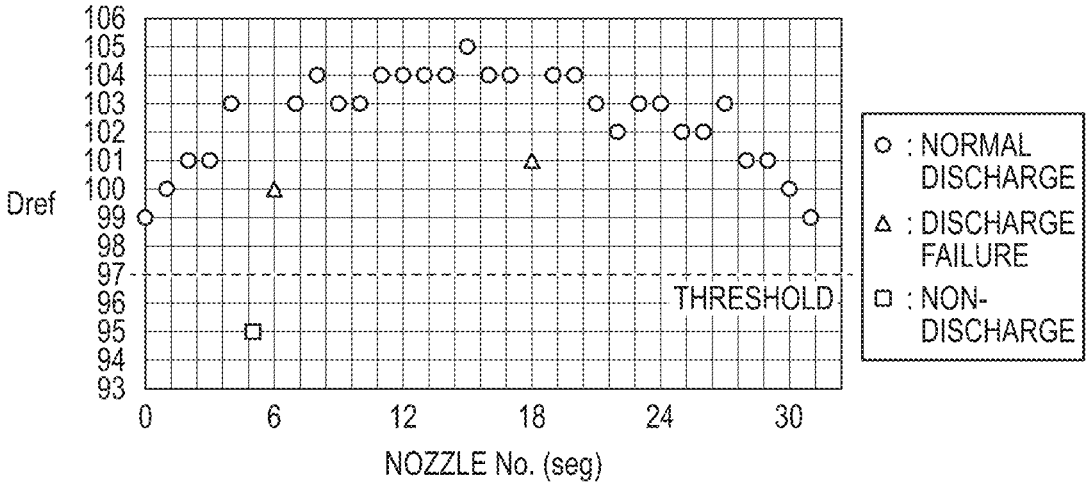
FIGS. 14A and 14B are views for explaining a method of calculating the value Ddiff according to the third embodiment.
Figure 14B:
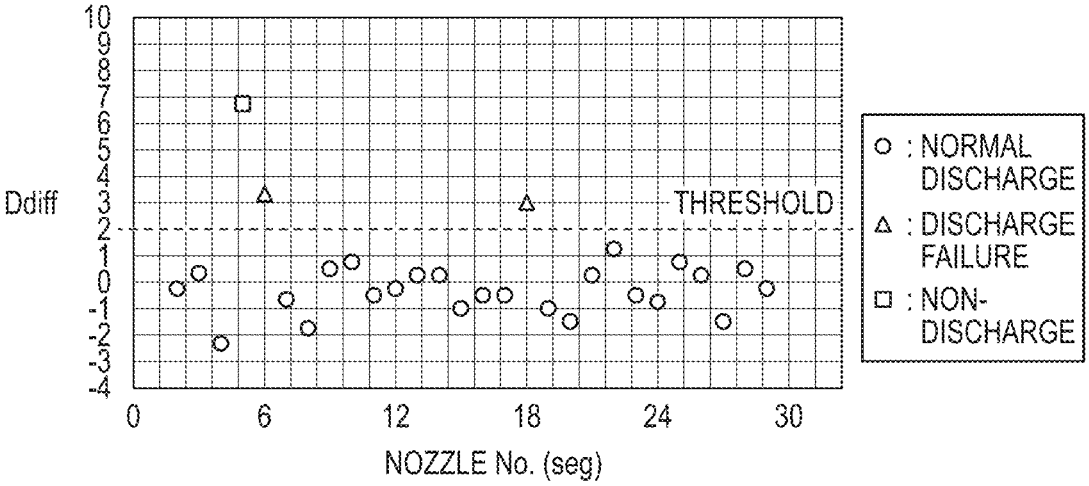

FIGS. 14A and 14B are views for explaining a method of calculating the value Ddiff according to this embodiment. Note that calculation of Ddiff in FIGS. 14A and 14B is performed using the same values Dref as those of the nozzles shown in FIG. 13A.

As shown in FIG. 14A, the value Dref of each nozzle is compared with a predetermined threshold, thereby specifying a non-discharge nozzle. In this example, the predetermined threshold is set to "97". Thus, the nozzle (seg 5) whose value Dref is smaller than the predetermined threshold is specified as a non-discharge nozzle.

Next, the Ddiff calculation processing described in the first or second embodiment is executed. In this embodiment, however, in the processing of calculating the average value of the values Dref of the adjacent nozzles, the value Dref of the non-discharge nozzle, that is, the value Dref of the nozzle (seg 5) is not used. Thus, if the processing target nozzle is seg 6, the average value of the values Dref of the three adjacent nozzles (seg 4, seg 7, and seg 8) is 103.3 and the value Dref of the nozzle (seg 6) is 100. Thus, the calculated value Ddiff is +3.3. If this value Ddiff is compared with 2.0 of the threshold (Ddiff_TH), Ddiff≥2.0 is satisfied and the processing target nozzle can be judged as a discharge failure or non-discharge nozzle. Furthermore, if comparison is performed using the two thresholds shown in FIG. 11 of the second embodiment, 2.0≤Ddiff<6.0 is satisfied, and the processing target nozzle can be judged as a discharge failure nozzle.

Therefore, according to the above-described embodiment, a non-discharge nozzle is specified before execution of the processing described in the first or second embodiment, and the value Dref of the non-discharge nozzle is excluded when calculating the average value of the values Dref of the adjacent nozzles of the processing target nozzle. Thus, even if the adjacent nozzles include a non-discharge nozzle, it is possible to judge the ink discharge status of the processing target nozzle more correctly by eliminating the influence of the non-discharge nozzle.

Note that in actual processing, it is only required not to use the value Dref of a non-discharge nozzle when calculating the average value of the values Dref of the adjacent nozzles. Therefore, a non-discharge nozzle may be specified and excluded in advance as in this example, or processing of excluding the smallest value of the values Dref of the adjacent nozzles may be performed when calculating the average value. If the value Dref of the specified non-discharge nozzle at the time of normal discharge is held, processing may be performed by replacing the value Dref with the held value.

As described above, a non-discharge nozzle is specified in advance before execution of the processing described in the first or second embodiment, and a value having a significantly large variation is excluded when calculating the average value of the values Dref of the adjacent nozzles, thereby making it possible to accurately detect the non-discharge or discharge failure status in any situation.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-157267, filed Aug. 29, 2019, which is hereby incorporated by reference herein in its entirety.

What is claimed is:

1. A printing apparatus comprising:

a printhead including a plurality of nozzles each configured to discharge ink, a plurality of energy generating elements respectively provided in the plurality of nozzles and each configured to generate energy used for discharging the ink from the nozzle, a plurality of detection elements provided in correspondence with the plurality of energy generating elements, and an output portion configured to output a signal indicating ink discharge statuses of the plurality of nozzles using the plurality of detection elements;

an inspection unit configured to inspect the ink discharge status while changing a threshold for judging the discharge status of a target nozzle based on the signal output by the output portion;

an obtaining unit configured to obtain, for the target nozzle, information concerning a change point at which a judgment result obtained by inspecting the ink discharge status by the inspection unit changes;

a calculation unit configured to calculate a difference value between a value obtained by statistics of information obtained by the obtaining unit for a plurality of nozzles close to the target nozzle and the information obtained by the obtaining unit for the target nozzle;

a comparison unit configured to compare the difference value calculated by the calculation unit with a predetermined threshold; and a judgment unit configured to judge the ink discharge status for the target nozzle based on a result of the comparison by the comparison unit.

2. The apparatus according to claim 1, wherein a nozzle array is formed by the plurality of nozzles, and the value obtained by the statistics of the information is calculated using a predetermined number of nozzles located on each side of the target nozzle with respect to the nozzle array.

3. The apparatus according to claim 1, wherein the ink discharge status includes an ink normal discharge status, an ink discharge failure status, and an ink non-discharge status.

4. The apparatus according to claim 3, wherein the judgment unit judges whether the ink discharge status is the ink normal discharge status, or is the ink discharge failure status or the ink non-discharge status.

5. The apparatus according to claim 4, further comprising:

a second comparison unit configured to compare the difference value calculated by the calculation unit with a predetermined second threshold different from the predetermined threshold; and a second judgment unit configured to judge, for the target nozzle, based on a result of the comparison by the second comparison unit, whether the ink discharge status is the ink discharge failure status or the ink non-discharge status.

6. The apparatus according to claim 5, wherein the value obtained by the statistics of the information is an average value of the information, and the apparatus further comprises a third comparison unit configured to compare, with a predetermined third threshold, the information obtained by the obtaining unit for each of the predetermined number of nozzles located on each side of the target nozzle, and wherein based on a result of the comparison by the third comparison unit, the calculation unit calculates the average value of the information by excluding a nozzle judged to be in the ink non-discharge status from the predetermined number of nozzles located on each side of the target nozzle or by replacing, with another value, the information obtained by the obtaining unit for the nozzle.

7. The apparatus according to claim 1, wherein the information is an average value of information obtained by the obtaining unit a plurality of times.

8. The apparatus according to claim 1, further comprising a storage unit configured to store, for each of the plurality of nozzles, the information obtained by the obtaining unit and the ink discharge status.

9. The apparatus according to claim 1, further comprising a processing unit configured to appropriately process printing by the printhead based on the ink discharge status.

10. The apparatus according to claim 9, wherein the processing by the processing unit includes complementary printing by a nozzle that normally discharges the ink and recovery processing of recovering the ink discharge status.

11. The apparatus according to claim 10, wherein the recovery processing includes at least one of execution of preliminary discharge of the printhead, execution of wiping of an orifice surface of the printhead, and execution of suction of a nozzle of the printhead.

12. The apparatus according to claim 1, wherein the inspection unit includes:

a signal generation unit configured to generate a selection signal for selecting, from the plurality of nozzles, a nozzle as a target of inspection of the ink discharge status, and an inspection threshold signal indicating the threshold, and output the signals to the printhead; and an instruction unit configured to instruct to change the nozzle indicated by the selection signal generated by the signal generation unit and a threshold indicated by the inspection threshold signal generated by the signal generation unit.

13. The apparatus according to claim 12, wherein the instruction unit instructs nozzles as targets of inspection by the inspection unit one by one.

14. The apparatus according to claim 1, wherein each of the plurality of energy generating elements is a heater for heating ink, and each of the plurality of detection elements obtains information on a temperature of the energy generating element corresponding to the detection element.

15. A control method for a printing apparatus for printing on a print medium using a printhead including a plurality of nozzles each configured to discharge ink, a plurality of energy generating elements respectively provided in the plurality of nozzles and each configured to generate energy used for discharging the ink from the nozzle, a plurality of detection elements provided in correspondence with the plurality of energy generating elements, and an output portion configured to output a signal indicating ink discharge statuses of the plurality of nozzles using the plurality of detection elements, the method comprising:

inspecting the ink discharge status while changing a threshold for judging the discharge status of a target nozzle based on the signal output by the output portion;

obtaining, for the target nozzle, information concerning a change point at which a judgment result obtained by inspecting the ink discharge status in the inspecting changes;

calculating a difference value between a value obtained by statistics of information obtained for a plurality of nozzles close to the target nozzle and the information obtained for the target nozzle;

comparing the calculated difference value with a predetermined threshold; and judging the ink discharge status for the target nozzle based on a result of the comparison.

16. The method according to claim 15, wherein the ink discharge status includes an ink normal discharge status, an ink discharge failure status, and an ink non-discharge status.

17. The method according to claim 16, wherein it is judged in the judging whether the ink discharge status is the ink normal discharge status, or is the ink discharge failure status or the ink non-discharge status.

18. The method according to claim 17, further comprising:

comparing the calculated difference value with a predetermined second threshold different from the predetermined threshold; and judging, for the target nozzle, based on a result of the comparison with the predetermined second threshold, whether the ink discharge status is the ink discharge failure status or the ink non-discharge status.

19. The method according to claim 18, wherein the value obtained by the statistics of the information is an average value of the information, wherein the method further comprises comparing, with a predetermined third threshold, the information obtained for each of a predetermined number of nozzles located on each side of the target nozzle, and wherein in the calculating, the average value of the information is calculated based on a result of the comparison with the third threshold by excluding a nozzle judged to be in the ink non-discharge status from the predetermined number of nozzles located on each side of the target nozzle or by replacing, with another value, the information obtained for the nozzle.

20. The method according to claim 15, further comprising storing, in a memory, the obtained information and the ink discharge status for each of the plurality of nozzles.

* * * * *